US008435119B2

(12) United States Patent
Hardy et al.

(10) Patent No.: US 8,435,119 B2
(45) Date of Patent: May 7, 2013

(54) USER-CONTROLLED SWEEPSTAKES ENTRIES

(75) Inventors: Dow K Hardy, Marlborough, MA (US); Mark E Herrmann, Wellesley, MA (US); Francis J Lichtenberger, Winchester, MA (US); Scott N Weller, Windham, NH (US); Michael C Lightman, Easton, CT (US); John E Taylor, Jr., Vero Beach, FL (US); Matthew S Ross, Natick, MA (US)

(73) Assignee: Scientific Games Holdings Limited, Ballymahon, Co. Longford (IE)

( * ) Notice: Subject to any disclaimer, the term of this patent is extended or adjusted under 35 U.S.C. 154(b) by 139 days.

(21) Appl. No.: 12/836,813

(22) Filed: Jul. 15, 2010

(65) Prior Publication Data

US 2011/0092267 A1 Apr. 21, 2011

Related U.S. Application Data

(63) Continuation-in-part of application No. 12/829,628, filed on Jul. 2, 2010, and a continuation-in-part of application No. 12/816,149, filed on Jun. 15, 2010, which is a continuation-in-part of application No. 12/345,289, filed on Dec. 29, 2008, and a continuation-in-part of application No. 12/238,849, filed on Sep. 26, 2008.

(60) Provisional application No. 61/222,647, filed on Jul. 2, 2009, provisional application No. 61/187,124, filed on Jun. 15, 2009, provisional application No. 61/225,864, filed on Jul. 15, 2009, provisional application No. 61/228,307, filed on Jul. 24, 2009, provisional application No. 61/016,801, filed on Dec. 26, 2007.

(51) Int. Cl.
*A63F 9/24* (2006.01)

(52) U.S. Cl.
USPC ..... 463/42; 463/25

(58) Field of Classification Search ..... 463/16–25, 463/40–42
See application file for complete search history.

(56) References Cited

U.S. PATENT DOCUMENTS 4,689,742 A 8/1987 Troy et al.
4,764,666 A 8/1988 Bergeron (Continued)

FOREIGN PATENT DOCUMENTS

EP 1833014 9/2007
WO WO 02/086845 10/2002

(Continued)

OTHER PUBLICATIONS

PCT Search Report, Sep. 15, 2011.

(Continued)

*Primary Examiner* — Masud Ahmed
(74) *Attorney, Agent, or Firm* — Dority & Manning, P.A.

(57) ABSTRACT

Provided are systems and methods for conducting sweepstakes, which can include a user controlled gaming award, wherein the user controlled gaming award includes entries in another game is provided. Entries into a sweepstakes game are associating with a unique identifier, which can be used to enter a plurality of sweepstakes games. A graphical user interface is configured to permit a player to assign awarded sweepstakes entries to at least one sweepstakes game, and further can be configured to permit the player to accumulate entries. The awarded entries can be configured as a form of currency redeemable for entry into at least one sweepstakes game. The methods and systems can permit the player to exchange any entry into a sweepstakes game. According to another embodiment of the invention, the method further comprises an act of permitting the player to exchange the custom currency. According to another embodiment, the method and systems are further configured to provide an exchange interface for trading of the custom currency.

30 Claims, 9 Drawing Sheets

U.S. PATENT DOCUMENTS

| | | | | |
|---|---|---|---|---|
| 4,882,473 | A | 11/1989 | Bergeron et al. | |
| 5,398,932 | A | 3/1995 | Eberhardt et al. | |
| 5,772,511 | A | 6/1998 | Smeltzer | |
| 5,779,549 | A | 7/1998 | Walker et al. | |
| 5,816,918 | A | 10/1998 | Kelly et al. | |
| 6,007,426 | A | 12/1999 | Kelly et al. | |
| 6,015,344 | A | 1/2000 | Kelly et al. | |
| 6,048,269 | A | 4/2000 | Burns et al. | |
| 6,113,495 | A | 9/2000 | Walker et al. | |
| 6,193,608 | B1 | 2/2001 | Walker et al. | |
| 6,224,486 | B1 | 5/2001 | Walker et al. | |
| 6,244,958 | B1 | 6/2001 | Acres | |
| 6,251,017 | B1 | 6/2001 | Leason et al. | |
| 6,302,793 | B1 | 10/2001 | Fertitta, III et al. | |
| 6,371,852 | B1 | 4/2002 | Acres | |
| 6,575,832 | B1 | 6/2003 | Manfredi et al. | |
| 6,663,105 | B1 | 12/2003 | Sullivan et al. | |
| 6,852,031 | B1 | 2/2005 | Rowe | |
| 6,910,968 | B2 | 6/2005 | Nassef | |
| 6,929,544 | B2 | 8/2005 | Osterer | |
| 6,969,319 | B2 | 11/2005 | Rowe et al. | |
| 7,094,149 | B2 | 8/2006 | Walker et al. | |
| 7,303,470 | B2 | 12/2007 | George et al. | |
| 7,490,830 | B2 | 2/2009 | Mirandette et al. | |
| 7,785,193 | B2 * | 8/2010 | Paulsen et al. | 463/25 |
| 2001/0034635 | A1 | 10/2001 | Winters | |
| 2002/0007313 | A1 | 1/2002 | Mai et al. | |
| 2002/0077173 | A1 | 6/2002 | Luciano et al. | |
| 2002/0093190 | A1 | 7/2002 | Katz | |
| 2002/0107072 | A1 | 8/2002 | Giobbi | |
| 2002/0116266 | A1 | 8/2002 | Marshall | |
| 2002/0155885 | A1 | 10/2002 | Shvili | |
| 2003/0032473 | A1 | 2/2003 | Rowe et al. | |
| 2003/0032476 | A1 | 2/2003 | Walker et al. | |
| 2003/0186739 | A1 * | 10/2003 | Paulsen et al. | 463/25 |
| 2004/0259631 | A1 | 12/2004 | Katz et al. | |
| 2005/0027599 | A1 | 2/2005 | Boyd et al. | |
| 2005/0049886 | A1 | 3/2005 | Grannan et al. | |
| 2005/0090314 | A1 | 4/2005 | Nassef, Jr. | |
| 2005/0124407 | A1 | 6/2005 | Rowe | |
| 2005/0164779 | A1 | 7/2005 | Okuniewicz | |
| 2005/0170883 | A1 * | 8/2005 | Muskin | 463/25 |
| 2006/0036450 | A1 | 2/2006 | Nassef, Jr. et al. | |
| 2006/0041586 | A1 | 2/2006 | Nassef, Jr. | |
| 2006/0089194 | A1 | 4/2006 | Joshi et al. | |
| 2006/0194631 | A1 | 8/2006 | Rowe et al. | |
| 2006/0247035 | A1 | 11/2006 | Rowe et al. | |
| 2007/0060274 | A1 | 3/2007 | Rowe et al. | |
| 2007/0067297 | A1 | 3/2007 | Kublickis | |
| 2007/0087834 | A1 | 4/2007 | Moser et al. | |
| 2007/0173322 | A1 | 7/2007 | Swamy | |
| 2007/0239716 | A1 | 10/2007 | Weininger et al. | |
| 2007/0265055 | A1 * | 11/2007 | Berman | 463/16 |
| 2008/0009344 | A1 * | 1/2008 | Graham et al. | 463/25 |
| 2008/0032763 | A1 | 2/2008 | Giobbi | |
| 2008/0045299 | A1 * | 2/2008 | Bennett et al. | 463/17 |
| 2008/0064492 | A1 | 3/2008 | Oosthoek | |
| 2009/0023490 | A1 * | 1/2009 | Moshal et al. | 463/17 |
| 2009/0054148 | A1 | 2/2009 | Hardy et al. | |
| 2009/0170608 | A1 | 7/2009 | Herrmann et al. | |
| 2009/0172035 | A1 * | 7/2009 | Lessing et al. | 707/104.1 |
| 2009/0176561 | A1 | 7/2009 | Rowe | |
| 2009/0197672 | A1 * | 8/2009 | Kelly et al. | 463/25 |
| 2009/0209350 | A1 * | 8/2009 | Kelly et al. | 463/42 |
| 2011/0111836 | A1 | 5/2011 | Acres | |
| 2011/0111855 | A9 | 5/2011 | Hardy et al. | |

FOREIGN PATENT DOCUMENTS

| | | |
|---|---|---|
| WO | WO 03089082 | 10/2003 |
| WO | WO 2004/114073 | 12/2004 |
| WO | WO 2006/028820 | 3/2006 |
| WO | WO 2006/052469 | 5/2006 |
| WO | WO 2007/145999 | 12/2007 |
| WO | WO 2008/014334 | 1/2008 |
| WO | WO 2008/022084 | 2/2008 |

OTHER PUBLICATIONS

PCT Search Report, Feb. 22, 2012.

* cited by examiner

USER-CONTROLLED SWEEPSTAKES ENTRIES

RELATED APPLICATIONS

This application is also a continuation-in-part of, and claims priority under 35 U.S.C. §120 to U.S. patent application Ser. No. 12/829,628, entitled "SYSTEM AND METHOD FOR INCREASING PLAYER PARTICIPATION" filed on Jul. 2, 2010, which claims priority under 35 U.S.C. 119(e) to U.S. Provisional Application Ser. No. 61/222,647 entitled "SYSTEM AND METHOD FOR INCREASING PLAYER PARTICIPATION," by Herrmann et al. filed on Jul. 2, 2009, each of which applications are incorporated by reference to herein in their entirety. This application is also a continuation-in-part of, and claims priority under 35 U.S.C. §120 to U.S. patent application Ser. No. 12/815,522, entitled, "SYSTEM AND METHOD FOR MANAGING CONTENT DELIVERY AND MEASURING ENGAGEMENT," filed on Jun. 15, 2010, which application claims priority under 35 U.S.C. 119(e) to U.S. Provisional Application Ser. No. 61/187,124 entitled "SYSTEM AND METHOD FOR MANAGING CONTENT DELIVERY AND MEASURING ENGAGEMENT," by Herrmann et al. filed on Jun. 15, 2009, each of which applications are incorporated by reference herein in their entirety. This application also claims priority under 35 U.S.C. 119(e) to U.S. Provisional Application Ser. No. 61/225,864, entitled "SYSTEM AND METHOD FOR ENGAGING AND ACQUIRING CUSTOMERS," by Weller, S., filed Jul. 15, 2009, incorporated herein by reference in its entirety. This application also claims priority under 35 U.S.C. 119(e) to U.S. Provisional Application Ser. No. 61/228,307, entitled "USER-CONTROLLED SWEEPSTAKES ENTRIES," filed on Jul. 24, 2009, incorporated herein by reference in its entirety.

FIELD OF INVENTION

The field of invention relates generally to gaming, and more particularly to an improved method of managing and conducting a sweepstakes system.

BACKGROUND

Sweepstakes are one of the most frequently used promotional tools in a marketer's toolbox. Participants engage in sweepstakes promotions for a chance to win a prize through a random drawing. Entries to sweepstakes promotions can be earned through a myriad of activities such as buying a product or service, participating in an activity, revealing personal information etc. Participants are also typically offered an Alternative Method of Entry (AMOE) which allows sweepstakes promotions to avoid issues regarding gambling laws.

Sweepstakes prize formats vary depending on the promotion and the marketing goals tied to the contest. For example, in 2005, McDonalds' through their Monopoly Sweepstakes promoted the fact there was $200 Million in prize money to won. They also advertised the promotion so that every man, woman and child in the United States saw or heard a marketing message about the promotion at least 3 times during the contest period.

Designing a sweepstakes involves several interrelated decisions such as allocating total prize budgets, total discrete prizes, max/min value of each prize or prize type, prize types (cash to or merchandise), total winners, structure of the sweepstakes (e.g., duration, frequency of drawings) etc. One schooled in the arts appreciates that marketers spend a considerable amount of their budgets to fund and advertise these promotions. It is also apparent that marketers seek to optimize their sweepstakes to derive maximum value from the contest.

SUMMARY

Currently there are two basic ways to design a sweepstakes contest. The first is where the odds of winning are known. Second is where the odds of winning are based on the total number of entries received. The drawback to traditional sweepstakes construct is that participants feel like they have a no control over the odds in either case.

An improvement over current implementations is to have a sweepstakes contest that allows participants to allocate their entries into specific contests that close down when contest reaches an entry threshold. Once the contest closes, a new sweepstakes contest is spawned to replace the old contest.

The benefits of this style of sweepstakes are twofold: First, it would allow participants to use strategy to help them decide when they should submit their entries. Second, it allows the marketer to decide the prize cost per entry and from that they can determine the return on invested prize dollar.

Lotteries, casinos and other gaming entities regularly use sweepstakes programs to award prizes and incentives as a way to generate revenue or enhance promotional activities. In most cases, the sweepstakes program is implemented simply by having a "bin"—either physical or virtual—where all sweepstakes entries are deposited and then the winners are drawn at some specified date and time. There is little-to-no feedback or control for the sweepstakes participant. If the participant is fortunate to win the sweepstakes, they are usually notified by the operator of the sweepstakes. Otherwise, the sweepstakes is concluded without most of the participants ever knowing the results.

One example approach to sweepstakes programs provides the capability for a sweepstakes participant to monitor their entries in a specific drawing or set of drawings. It also allows the participant to see total entries into the drawing and winners from previous drawings. All this is provided in near-real time and provides a much better sweepstakes experience for the participant.

Further embodiments include capabilities that can be extended to a system where the participant is allowed to take an action, such as redeeming a coupon, that then awards the to participant sweepstakes entries for current or future sweepstakes drawing of his/her choosing. The participant may be presented with a listing of the current sweepstakes that are accepting entries along with any entries the participant may already have entered into those sweepstakes. The participant may also elect to defer the choice of entering one of the current sweepstakes and place their entries into a repository for future use. The sweepstakes entries may have associated expiration or use policies (e.g. expiration dates, only good for certain promotions, variable effective value). The repository would track expiration and use policies for all sweepstakes entries being stored in the repository. The participant would then monitor (manually or via a rules-based proxy) current and future sweepstakes to determine if/when to assign sweepstakes entries to a specific sweepstakes.

According to one aspect of the present invention, a method for providing a user controlled gaming award, wherein the user controlled gaming award includes entries in another game is provided. The method comprising the acts of providing an entry into a sweepstakes game to a player, associating the entry into the sweepstakes game with a unique identifier; providing a plurality of sweepstakes games, providing a graphical user interface configured to permit the player to assign sweepstakes entries to at least one sweepstakes game, and permitting the player to accumulate entries. According to one embodiment of the present invention, the act of providing an entry into a sweepstakes game to the player includes an act of providing a custom currency redeemable for entry into at least one sweepstakes game. According to another embodiment of the invention, the method further comprises an act of permitting the player to exchange the entry into the sweepstakes game. According to another embodiment of the invention, the method further comprises an act of permitting the player to exchange the custom currency. According to another embodiment of the invention, the method further comprises an act of providing an exchange interface for trading of the custom currency.

According to one embodiment of the present invention, the exchange interface is configured to display information associated with the sweepstakes entry. According to another embodiment of the invention, the information associated with the sweepstakes entry includes at least one of an expiration for the sweepstakes entry, a value of any outcome of a sweepstakes game associated with the entry, a sweepstake game level associated with the entry, a total number of sweepstakes entries submitted for the sweepstakes game associated with the sweepstakes entry, an outcome of the sweepstakes game associated with the sweepstakes entry, a time for redemption of the sweepstakes entry, a cash value of a prize associated with the entry, and a cash equivalent value of a prize associated with the entry. According to another to embodiment of the invention, the method further comprises the acts of associating an account with the player, and permitting the player to bank any sweepstakes entry in the account. According to another embodiment of the invention, the method further comprises an act of reducing any sweepstakes entry balance on a predetermined interval. According to another embodiment of the invention, the act of providing an entry into a sweepstakes game occurs in response to an act of permitting the player to play a game.

According to one embodiment of the invention, the act of providing an entry into a sweepstakes game occurs in response to an act of requiring the player to perform an action, play a game. According to another embodiment of the invention, the game includes at least one of a reveal based game, a second chance game, an online game, an offline game, and a game comprising an online and offline portion. According to another embodiment of the invention, the act of providing a custom currency redeemable for entry into at least one sweepstakes game, includes an act of permitting the player to purchase entries into the sweepstakes game using the custom currency. According to another embodiment of the invention, an act of displaying game related information for at least one of the plurality of sweepstakes games. According to another embodiment of the invention, the game related information includes at least one of a start time, an end time, an enrolment time, a closing time, a minimum number of entries, a maximum number of entry, a sweepstake game status, a current number of entries, a remaining number of entries, a tiering level for the sweepstakes game.

According to one embodiment of the present invention, the act of providing a plurality of sweepstakes games includes an act of varying a value of outcome of the plurality of sweepstakes game. According to another embodiment of the invention, the act of providing an entry into a sweepstakes game to a player includes an act of assigning a value to the sweepstakes entry. According to another embodiment of the invention, the act of providing an entry into the sweepstakes game to a player includes an act of establishing any restrictions on redemption of the entry. According to another embodiment of the invention, any restrictions on redemption of the entry includes at least one of an expiration for the sweepstakes entry, a value of any outcome of a sweepstakes game associated with the entry, a sweepstake game tier associated with the entry, a total number of sweepstakes entries permitted for the sweepstakes game associated with the sweepstakes entry, an outcome of the sweepstakes game associated with the sweepstakes entry, a time for redemption of the sweepstakes entry, a cash value of a prize associated with the entry, a cash equivalent value of a prize associated with the entry, a to maximum cash value of a prize associated with the entry, a minimum cash value of a prize associated with the entry, a maximum cash-equivalent value of a prize associated with the entry, a minimum cash-equivalent value of a prize associated with the entry, any restriction on exchanging the entry. According to another embodiment of the invention, the method further comprises an act of displaying a leader board in a graphical user interface.

According to one embodiment of the present invention, the method further comprises an act of providing a play engine configured to permit a player to establish sweepstakes entry rule that automatically enter a player into sweepstakes games based upon player specified criteria. According to another embodiment of the invention, the plurality of sweepstakes games includes at least one automatically generated sweepstakes game. According to another embodiment of the invention, the method further comprises an act of displaying criteria for the at least one automatically generated sweepstakes game, wherein the criteria includes at least one of start time for accepting entries into the at least one automatically generated sweepstakes game, sweepstakes game prize, maximum number of entries, minimum number of entries, and required entry tier. According to another embodiment of the invention, the method further comprises an act of opening an entry period into a sweepstakes game in response to meeting predefined criteria. According to another embodiment of the invention, the predefined criteria include at least one of a conclusion of an entry period for another sweepstakes game and a maximum number of entries accepted into a sweepstakes game. According to another embodiment of the invention, the method further comprises an act of adjusting a number of redeemed sweepstakes entries based on a selected sweepstakes game being entered.

According to one embodiment of the present invention, the act of adjusting the number of redeemed sweepstakes entries based on the selected sweepstakes game being entered includes an act of reducing the number of redeemed entries by a valuation factor, wherein the provided entry is associated with an outcome of a particular value, and the entered sweepstakes includes an outcome of greater value. According to another embodiment of the invention, the act of adjusting the number of redeemed sweepstakes entries based on the selected sweepstakes game being entered includes an act of reducing the number of redeemed entries by a valuation factor, wherein the provided entry is associated with an outcome of a particular value, and the entered sweepstakes includes an outcome of greater value. According to another embodiment of the invention, the method further comprises acts of determining a valuation factor based at least in part on a relative value of an outcome of the provided entry into the sweepstakes game and a value of an outcome of an entered sweepstakes game, adjusting a number of entered to sweepstakes based at least in part on the valuation factor. According to another embodiment of the invention, the act of determining the valuation factor includes an act of adjusting the valuation factor based on player status.

According to one aspect of the present invention, a non-transient computer readable medium including instructions for performing a method of providing a user controlled gaming award is provided. The method comprising the acts of providing an entry into a sweepstakes game to a player, associating the entry into the sweepstakes game with a unique identifier, providing a plurality of sweepstakes games, providing a graphical user interface configured to permit the player to assign sweepstakes entries to at least one sweepstakes game, and permitting the player to accumulate entries. According to one embodiment of the present invention, the act of providing an entry into a sweepstakes game to the player includes an act of providing a custom currency redeemable for entry into at least one sweepstakes game. According to another embodiment of the invention, the method further comprises an act of permitting the player to exchange the entry into the sweepstakes game. According to another embodiment of the invention, the method further comprises an act of permitting the player to exchange the custom currency. According to another embodiment of the invention, the method further comprises an act of providing an exchange interface for trading of the custom currency.

According to one embodiment of the present invention, the exchange interface is configured to display information associated with the sweepstakes entry. According to another embodiment of the invention, the information associated with the sweepstakes entry includes at least one of an expiration for the sweepstakes entry, a value of any outcome of a sweepstakes game associated with the entry, a sweepstake game level associated with the entry, a total number of sweepstakes entries submitted for the sweepstakes game associated with the sweepstakes entry, an outcome of the sweepstakes game associated with the sweepstakes entry, a time for redemption of the sweepstakes entry, a cash value of a prize associated with the entry, and a cash equivalent value of a prize associated with the entry. According to another embodiment of the invention, the method further comprises the acts of associating an account with the player, and permitting the player to bank any sweepstakes entry in the account. According to another embodiment of the invention, the method further comprises an act of reducing any sweepstakes entry balance on a predetermined interval. According to another embodiment of the invention, the act of providing an entry into a sweepstakes game occurs in response to an act of permitting the player to play a game.

According to one embodiment of the invention, the act of providing an entry into a to sweepstakes game occurs in response to an act of requiring the player to perform an action, play a game. According to another embodiment of the invention, the game includes at least one of a reveal based game, a second chance game, an online game, an offline game, and a game comprising an online and offline portion. According to another embodiment of the invention, the act of providing a custom currency redeemable for entry into at least one sweepstakes game, includes an act of permitting the player to purchase entries into the sweepstakes game using the custom currency. According to another embodiment of the invention, an act of displaying game related information for at least one of the plurality of sweepstakes games. According to another embodiment of the invention, the game related information includes at least one of a start time, an end time, an enrolment time, a closing time, a minimum number of entries, a maximum number of entry, a sweepstake game status, a current number of entries, a remaining number of entries, a tiering level for the sweepstakes game.

According to one embodiment of the present invention, the act of providing a plurality of sweepstakes games includes an act of varying a value of outcome of the plurality of sweepstakes game. According to another embodiment of the invention, the act of providing an entry into a sweepstakes game to a player includes an act of assigning a value to the sweepstakes entry. According to another embodiment of the invention, the act of providing an entry into the sweepstakes game to a player includes an act of establishing any restrictions on redemption of the entry. According to another embodiment of the invention, any restrictions on redemption of the entry includes at least one of an expiration for the sweepstakes entry, a value of any outcome of a sweepstakes game associated with the entry, a sweepstake game tier associated with the entry, a total number of sweepstakes entries permitted for the sweepstakes game associated with the sweepstakes entry, an outcome of the sweepstakes game associated with the sweepstakes entry, a time for redemption of the sweepstakes entry, a cash value of a prize associated with the entry, a cash equivalent value of a prize associated with the entry, a maximum cash value of a prize associated with the entry, a minimum cash value of a prize associated with the entry, a maximum cash-equivalent value of a prize associated with the entry, a minimum cash-equivalent value of a prize associated with the entry, any restriction on exchanging the entry. According to another embodiment of the invention, the method further comprises an act of displaying a leader board in a graphical user interface.

According to one embodiment of the present invention, the method further comprises an act of providing a play engine configured to permit a player to establish sweepstakes entry to rule that automatically enter a player into sweepstakes games based upon player specified criteria. According to another embodiment of the invention, the plurality of sweepstakes games includes at least one automatically generated sweepstakes game. According to another embodiment of the invention, the method further comprises an act of displaying criteria for the at least one automatically generated sweepstakes game, wherein the criteria includes at least one of start time for accepting entries into the at least one automatically generated sweepstakes game, sweepstakes game prize, maximum number of entries, minimum number of entries, and required entry tier. According to another embodiment of the invention, the method further comprises an act of opening an entry period into a sweepstakes game in response to meeting predefined criteria. According to another embodiment of the invention, the predefined criteria include at least one of a conclusion of an entry period for another sweepstakes game and a maximum number of entries accepted into a sweepstakes game. According to another embodiment of the invention, the method further comprises an act of adjusting a number of redeemed sweepstakes entries based on a selected sweepstakes game being entered.

According to one embodiment of the present invention, the act of adjusting the number of redeemed sweepstakes entries based on the selected sweepstakes game being entered includes an act of reducing the number of redeemed entries by a valuation factor, wherein the provided entry is associated with an outcome of a particular value, and the entered sweepstakes includes an outcome of greater value. According to another embodiment of the invention, the act of adjusting the number of redeemed sweepstakes entries based on the selected sweepstakes game being entered includes an act of reducing the number of redeemed entries by a valuation factor, wherein the provided entry is associated with an outcome of a particular value, and the entered sweepstakes includes an outcome of greater value. According to another embodiment of the invention, the method further comprises acts of determining a valuation factor based at least in part on a relative value of an outcome of the provided entry into the sweepstakes game and a value of an outcome of an entered sweepstakes game, adjusting a number of entered sweepstakes based at least in part on the valuation factor. According to another embodiment of the invention, the act of determining the valuation factor includes an act of adjusting the valuation factor based on player status.

According to one aspect of the present invention, a system for providing a user controlled gaming award is provided. The system comprising an awarding component configured to provide an entry into a sweepstakes game to a player, an associated component configured to associate the entry into the sweepstakes game with a unique identifier, a to sweepstakes interface configured to display a plurality of sweepstakes games, and further configured to permit the player to assign sweepstakes entries to at least one sweepstakes game, and a management component configured to permit the player to accumulate sweepstakes entries.

According to one embodiment, the awarding component is further configured to provide a custom currency redeemable for entry into at least one sweepstakes game.

According to one embodiment, the system comprises an exchange component configured to permit the player to exchange the entry into the sweepstakes game. According to one embodiment, the system further comprises an exchange component configured to permit the player to exchange the custom currency. According to one embodiment, the sweepstakes interface is further configured to display an exchange interface configured to trade the custom currency. According one embodiment, the exchange interface is configured to display information associated with the sweepstakes entry. According to one embodiment, the information associated with the sweepstakes entry includes at least one of an expiration for the sweepstakes entry, a value of any outcome of a sweepstakes game associated with the entry, a sweepstake game level associated with the entry, a total number of sweepstakes entries submitted for the sweepstakes game associated with the sweepstakes entry, an outcome of the sweepstakes game associated with the sweepstakes entry, a time for redemption of the sweepstakes entry, a cash value of a prize associated with the entry, and a cash equivalent value of a prize associated with the entry.

According to one embodiment, the system further comprises a registration component configured to associate an account with the player, and wherein the management component is further configured to permit the player to bank any sweepstakes entry in the account. According to one embodiment, the management component is further configured to expire sweepstakes entries. According to one embodiment, the sweepstakes entries expire on a predetermined interval. According to one embodiment, the award component is configured to provide an entry into a sweepstakes game in response to the player to playing a game. According to one embodiment, the award component is configured to provide an entry into a sweepstakes game in response to requiring the player to perform a non-gaming action. According to one embodiment, he game includes at least one of a reveal based game, a second chance game, an online game, an offline game, and a game comprising an online and offline portion. According to one embodiment, the custom currency is configured to permit the player to purchase entries into the sweepstakes game. According to one embodiment, the to sweepstakes interface is further configured to display game related information for at least one of the plurality of sweepstakes games.

According to one embodiment, the game related information includes at least one of a start time, an end time, an enrolment time, a closing time, a minimum number of entries, a maximum number of entry, a sweepstake game status, a current number of entries, a remaining number of entries, a tiering level for the sweepstakes game. According to one embodiment, the plurality of sweepstakes games includes a respective outcome of varying a value. According to one embodiment, the award component is further configured to assign a value to the sweepstakes entry. According to one embodiment, the award component is further configured to identify any restrictions on redemption of the entry. According to one embodiment, any restrictions on redemption of the entry includes at least one of an expiration for the sweepstakes entry, a value of any outcome of a sweepstakes game associated with the entry, a sweepstake game tier associated with the entry, a total number of sweepstakes entries permitted for the sweepstakes game associated with the sweepstakes entry, an outcome of the sweepstakes game associated with the sweepstakes entry, a time for redemption of the sweepstakes entry, a cash value of a prize associated with the entry, a cash equivalent value of a prize associated with the entry, a maximum cash value of a prize associated with the entry, a minimum cash value of a prize associated with the entry, a maximum cash-equivalent value of a prize associated with the entry, a minimum cash-equivalent value of a prize associated with the entry, any restriction on exchanging the entry.

According to one embodiment, the sweepstakes interface is further configured to display a leader board. According to one embodiment, the management component is further configured to permit a player to establish sweepstakes entry rule that automatically enters a player into sweepstakes games based upon player specified criteria. According to one embodiment, the plurality of sweepstakes games includes at least one automatically generated sweepstakes game. According to one embodiment, the sweepstakes interface is further configured to display criteria for the at least one automatically generated sweepstakes game, wherein the criteria includes at least one of start time for accepting entries into the at least one automatically generated sweepstakes game, sweepstakes game prize, maximum number of entries, minimum number of entries, and required entry tier. According to one embodiment, the award component is further configured to open an entry period into a sweepstakes game in response to meeting predefined criteria. According to one embodiment, the predefined criteria includes at least one of a conclusion of an entry period for another sweepstakes game and a to maximum number of entries accepted into a sweepstakes game. According to one embodiment, the sweepstakes interface is further configured to adjust a number of redeemed sweepstakes entries based on a selected sweepstakes game being entered. According to one embodiment, the sweepstakes interface is further configured to reduce the number of redeemed entries by a valuation factor, wherein the provided entry is associated with an outcome of a particular value, and the entered sweepstakes includes an outcome of greater value.

According to one embodiment, the system further comprises a valuation component configured to determine a valuation factor based at least in part on a relative value of an outcome of the provided entry into the sweepstakes game and a value of an outcome of an entered sweepstakes game and an adjustment component configured to adjust a number of entered sweepstakes based at least in part on the valuation factor. According to one embodiment, the adjustment component is further configured to adjust the valuation factor based on player status.

BRIEF DESCRIPTION OF THE DRAWINGS

Various aspects of at least one embodiment are discussed herein with reference to the accompanying figures, which are not intended to be drawn to scale. The figures are included to provide illustration and a further understanding of the various aspects and embodiments, and are incorporated in and constitute a part of this specification, but are not intended as a definition of the limits of the invention. Where technical features in the figures, detailed description or any claim are followed by references signs, the reference signs have been included for the sole purpose of increasing the intelligibility of the figures, detailed description, and/or claims. Accordingly, neither the reference signs nor their absence are intended to have any limiting effect on the scope of any claim elements. In the figures, each identical or nearly identical component that is illustrated in various figures is represented by a like numeral. For purposes of clarity, not every component may be labeled in every figure. In the figures:

DETAILED DESCRIPTION

Awarding of Sweepstakes Entries

Figure 1:
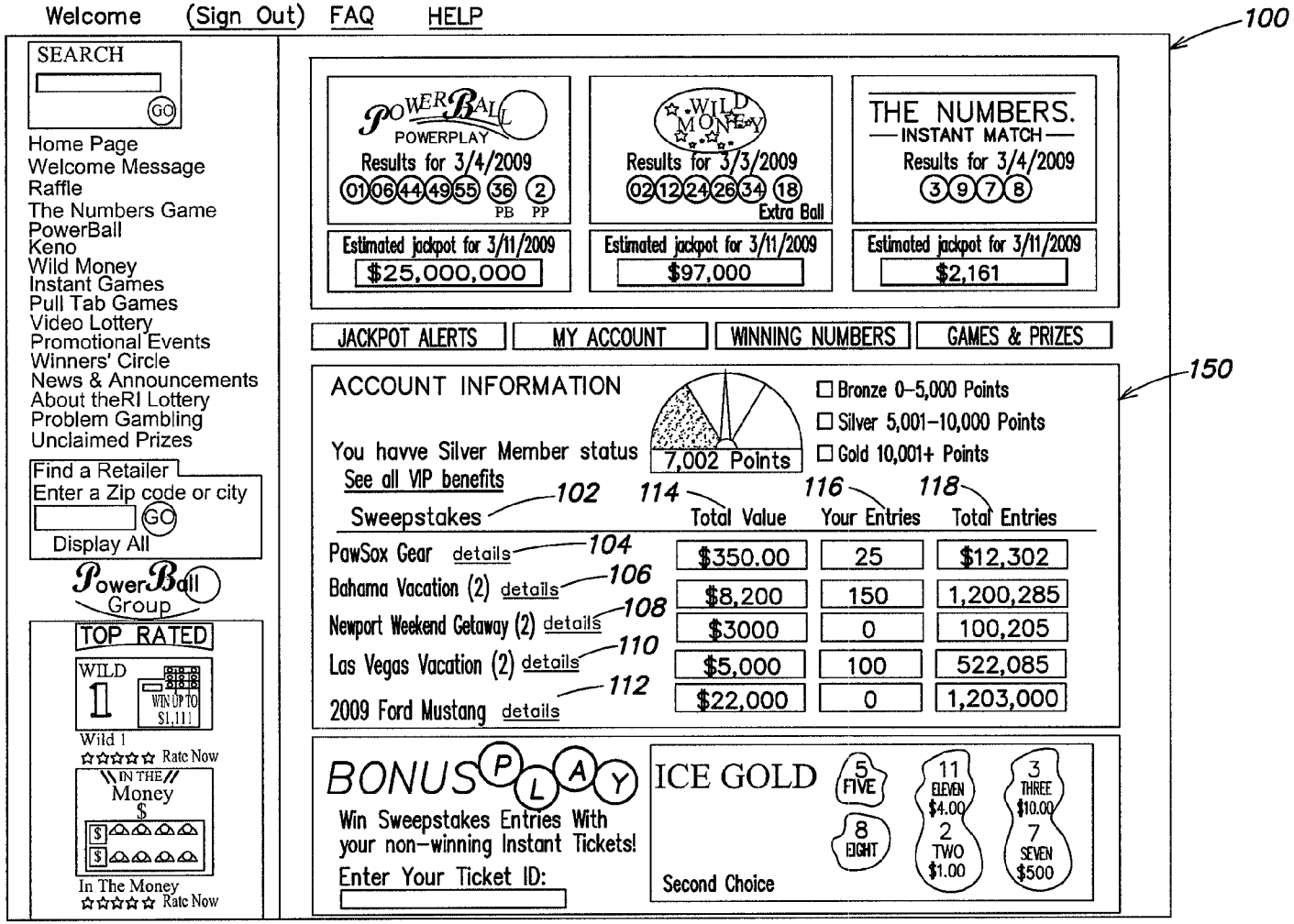
FIG. 1 is a screen capture of an example user interface, according to aspects of the invention.

Sweepstakes entries may be awarded in a wide variety of manners. They may be purchased with currency, loyalty program points or third party currencies. They may be awarded in a game of chance, a game of skill or a game that reveals a pre-determined outcome. These games may be conducted either within a physical medium (e.g. scratch ticket) or online via a website game. These examples are simply illustrative and are not intended to limit the ways sweepstakes entries may be awarded.

Sweepstakes entries may be awarded as a pre-determined outcome of a reveal technology game. Some embodiments of reveal element games and methodologies are discussed in co-pending U.S. application Ser. No. 11/001,775, by Kane et al, entitled "METHOD AND APPARATUS FOR CONDUCTING A GAME OF CHANCE," filed on Nov. 30, 2004 incorporated herein by reference in its entirety. Sweepstakes entries may be awarded as part of a second chance lottery game. Some aspects and examples of second chance lottery games are discussed in co-pending U.S. application Ser. No. 11/789,693 entitled "METHOD AND APPARATUS FOR CONDUCTING A GAME OF CHANCE," to Herrmann et al. filed on Apr. 25, 2007, and to U.S. Provisional Application Ser. No. 61/222,647 "SYSTEM AND METHOD FOR INCREASING PLAYER PARTICIPATION," by Herrmann et al, filed on Jul. 2, 2009, which applications are incorporated herein by reference in their entirety.

Sweepstakes prizes—those items that may be won as a result of winning the sweepstakes—may include anything of real or perceived value. Examples of possible prizes include: cash, loyalty points, merchandise, entry into additional games or promotions, etc.

In one embodiment, the gambling establishment may offer multiple sweepstakes, contests, or drawings with different prizes or other incentives and/or different drawing dates. As the player wins or earns entries via gaming and/or related activity (e.g. play of the second chance game or games) the player can allocate the entries towards the sweepstakes, contests, or drawings of his or her own choosing. The player can allocate the entries immediately upon receipt, or the player can accumulate and keep the entries and allocate them at some later time. These "banked" entries may or may not expire at some point in time. In another embodiment, the award can be a multiplier of your currently unassigned sweepstakes entries.

Multipliers may take many forms. Once a sweepstakes entry has been awarded, many factors can be applied to prompt a player to take a desired activity. Multipliers to awarded entries can be offered to players as incentive to perform desired behavior. Players who are awarded entries based on on-line activity can be presented with opportunities to multiply their accumulated entries for performing real world activity. For example, a visit to an actual casino would effect a multiplier on any accumulated balance. In another example, a player who typically visits casinos can be provided a multiplier for accessing an on-line site. Multipliers can be employed as further behavior incentives, and the success or failure of the incentive can further be used to build out player profiles. Multipliers can be awarded automatically upon completion of an activity, and in some examples multipliers can be batch processed. Typically a player is notified about a redemption period, if any, applies.

Sweepstakes Assignment Interface

In one embodiment, the interface for assignment of sweepstakes entries to specific sweepstakes is represented in FIG. 1. The interface 100 displays current and future sweepstakes for which the entries are valid. At 102, all sweepstakes presently entered into are displayed to an end user by interface 100. The end user may be accessing the interface over a communication network, for example the Internet. A server system can be configured to present the interface 100 as for example a web page access by a host computer system executing a browser program. Sweepstakes games 104-112 each provide an interesting incentive to the particular end user. The selection of these particular sweepstakes games can to be stored as part of a player profile. The player profile can be used to tailor subsequent sweepstake game offers to the end user. An account information dashboard 150, provides additional information on the sweepstakes 104-112. For example, a total value of the prizes that can be won in a particular sweepstakes can be displayed in dashboard 150 at 114. The display of the total value can serve as an incentive for a user to participate in a particular sweepstakes game. Moreover, some activities by a user can be rewarded by providing entries into specific sweepstakes. In one alternatively, a user can be awarded entries that can be entered into any sweepstake. In another alternative, various levels can be assigned to sweepstakes entries permitting entry for example up to a certain total prize value. A sweepstakes entry system can be configured to exchange sweepstake of one level for another, permitting access to a higher level sweeps entry in exchange for multiple lesser level entries. Further a higher level entry could be exchanged for multiple lower lever entries.

The player may also be able to view the number of total entries from all participants in each sweepstakes, contest, or drawing, and may also see their own number of entries at 118.

For example, the player may see that they have accumulated and allocated 500 entries in the "$10,000 Monthly Sweepstakes" drawing and 250 entries in the "Trip for Two to Las Vegas Sweepstakes", and that the accumulated entries of all other players total 223,000 and 350,000, respectively. This may provide the player with additional motivation to participate because the player can customize the incentives to their personal interests as well as strategize about the best place to allocate entries. In one embodiment (not shown), the interface can also display a maximum number of entries for a particular sweepstakes game. A display of a maximum number of entries for the sweepstakes game can be combined with accumulated sweepstakes entries to permit a user to capture all the entries for a particular sweepstakes, guaranteeing a win. Sweepstakes exchanges can facilitate this behavior, by permitting a user to swap for the sweepstakes entries need to guarantee a sweepstakes win. In some embodiments, a maximum number of entries can provide information on restrictions for individual player access. In particular, a sweepstakes operator may wish to preserve fairness to participates, and thus in some example, limit the number of entries per player.

In one embodiment, the interface is customizable to show only sweepstakes that match certain criteria. These criteria may be determined by the system or determined by the user. Odds of winning is one criterion that may be used. For instance, a user may elect to only see sweepstakes where total entries are less than 9× the number of entries he/she has available. This would allow the user to enter sweepstakes that afford the user at least a 10% chance of to winning. As another example, the user may elect to only see sweepstakes that have a cash, or cash-equivalent, prize greater than some value. As another example, the user may elect to only see sweepstakes related to a certain affinity or interest such as only wanting to see sports-based sweepstakes with prizes that can include sports tickets, sports memorabilia/merchandise, sports attire, etc.

In another embodiment, the customization of the sweepstakes assignment interface includes the ability to display in a time-based fashion—past sweepstakes, currently running sweepstakes in which the user is entered, currently running sweepstakes in which the user is not entered, and future scheduled sweepstakes.

In another embodiment, the interface may be updated to show the total number of entries in a sweepstakes along with the criteria for when the sweepstakes entry period will end. This enables the player to allocate the entries into a sweepstakes at a time when it might be most advantageous to the player. For example, if a particular sweepstakes automatically draws and renews every time the number of entries reaches 100,000, the player may wait to accumulate 10,000 entries and then allocate them to the sweepstakes. This would give the player a 1 in 10 chance of winning.

In another embodiment, the assignment interface enforces operators' rules with regard to either minimum or maximum entries that can be assigned to a sweepstakes by an individual. Enforcing a minimum number of entries establishes a sense of exclusivity with respect to the sweepstakes drawing. Enforcing a maximum number of entries establishes a sense of fairness with respect to the drawing such that a person with a large number of entries cannot "buy" the sweepstakes prize by entering significantly more entries than other entrants.

In another embodiment, the sweepstakes assignment interface may list a leader board of players and their sweepstakes entries (assigned, un-assigned or both). In another embodiment, the system may display the total number of un-assigned sweepstakes entries, thus providing another measure of value to the player's sweepstakes entries. If a player has 100,000 un-assigned sweepstakes entries and there are only 1,000,000 total un-assigned entries, then his entries may be considered worth 10% of the entire current prize pool. As one skilled in the art can appreciate, players are competitive with respect to any measure of value. The leader board not only encourages more play, but gives the players an understanding of the potential value of their sweepstakes entries.

Figure 4:
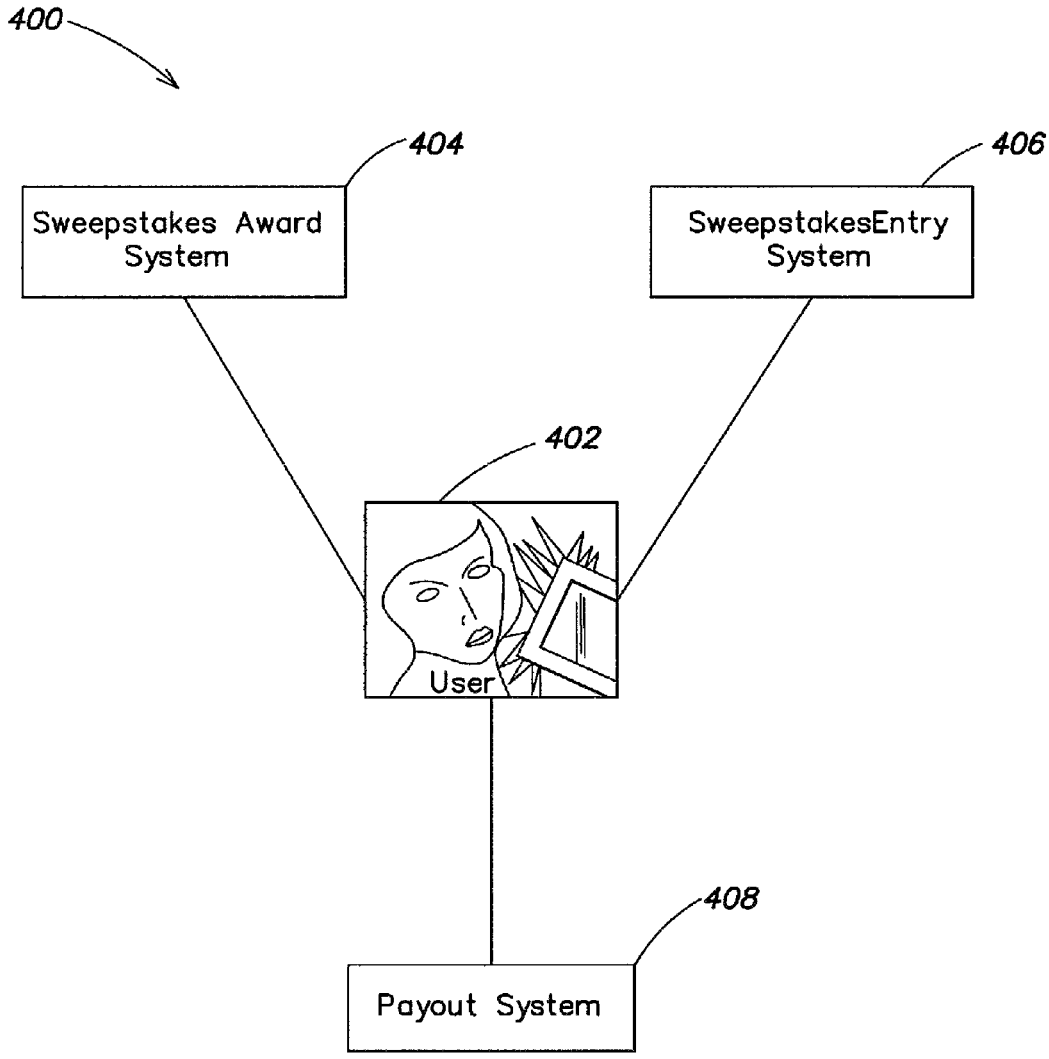
FIG. 4 is a block diagram of an example sweepstakes award system, according to aspects of the invention.

In one embodiment, the sweepstakes interface is provided by accessing a computer server over a communication network. In one example, the computer server can host the to functions and manage operations associated with a sweepstakes entry system. FIG. 4 illustrates an example sweepstakes platform 400. A user 402 can use a host computer system, which can be a general purpose computer system with special programming, to access a sweepstakes award system 404. A player may play a game and in response be awarded sweepstakes entries. In some embodiments, the sweepstakes award system 404 may include a game play system (not shown) and in some embodiments the sweepstakes award system can be operatively connected to a game play system.

The user 402, can access a sweepstakes entry system 406 using a host computer system connected to a communication network. The host computer system can be a standard desktop or laptop computer system, or in some embodiments, a cell phone, PDA, mobile device, and smart phones. In one example the communication network is the Internet. The sweepstakes entry system 406 can be configured to display an interface to the user in s browser program executing on the host computer. The interface provided is configured to permit the user to access their sweepstakes account, and perform operations associated with entering sweepstakes, which can include for example any one or more of assigning sweepstakes entries to user selected sweepstakes, configuring preferences to display user preferred sweepstakes games, accumulating sweepstakes entries, exchanging sweepstakes entries The sweepstakes awards system 404 can be operatively connected to a separate sweepstakes entry system 406 configured to retain information on awarded entries. The award and entry systems can be one system and in some embodiments can be separate systems that communicate. In some settings, the operations and functions performed by the entry and award systems can be distributed across multiple computer system. In the event that a user wins a sweepstakes game a separate payout system 408 may be provided. One should appreciate that although FIG. 4 illustrates separate computer systems for each or the award, entry and payout systems 408 such systems can be provided in as one system, and further can be distributed across additional systems.

Sweepstakes Entries of Varying Value

In one embodiment, the system for awarding sweepstakes entries awards entries of differing value to the users. As an example, sweepstakes entries are assigned a tiering structure of: Gold, Silver, and Bronze. Not only can a person win varying numbers of sweepstakes entries, but they can also win varying tiers of sweepstakes entries. In this example, Gold entries never expire and are usable across all sweepstakes drawings while Silver entries expire in two weeks but are usable across all sweepstakes drawings while Bronze entries expire in one week and are only usable on sweepstakes drawings where the estimated prize value is less than $1000. The user interface for assigning sweepstakes entries would then enforce the distinctions between tiers of entries. As another example, the sweepstakes entries may not have tiers, but, rather, would just have varying redemption times or prize eligibility (can only be used for sweepstakes with non-cash prizes).

In another embodiment, sweepstakes entries of differing value may then be traded or exchanged by the sweepstakes operator or with other players. A player may exchange sweepstakes entries that are about to expire for ones with longer expiration periods if there are no current sweepstakes that are of interest. The sweepstakes operator may implement an exchange rate, for example, of 10 expiring sweepstakes entries for 3 sweepstakes entries with a 3 month (future) expiration date. Another player might also trade their 10 never-expire sweepstakes entries for 20 expiring sweepstakes entries, if there was a current sweepstakes in which they were interested. Operation of exchange can determined a standard exchange rate that can be applied. In one alternative market force ultimately determine an exchange rate that applies.

Sweepstakes Entries Use Policies and Enhancements

In one embodiment, the user may configure a rules-based proxy for assigning his/her sweepstakes entries. As an example, the user could indicate to the system that all sweepstakes entries should be evenly distributed over eligible sweepstakes with a grand prize over a certain retail value. The criteria for the rules-based proxy may include: potential prize value (e.g. only assign entries to sweepstakes with estimated prize values above a dollar threshold); prize types (e.g. only assign entries for sweepstakes awarding cash or cash equivalents); probability of winning (e.g. only assign entries for sweepstakes where total entries less than some value);

The system may also allow for entries to be multiplied or, in some other way, enhanced. Another example of how the sweepstakes entries could be enhanced would be to extend their expiration times. Additionally, the sweepstakes entries could be enhanced by making them eligible for different, and possibly more exclusive, sweepstakes drawings.

In some cases, the sweepstakes operator may find it desirable to have the player use a majority, if not all, of their sweepstakes entries in a timely fashion, thus reducing the liability of a large number of unassigned sweepstakes entries. In one embodiment, the number of assignable sweepstakes entries may change based on certain criteria. In one example, the number of sweepstakes entries may degrade over time if they are unassigned. If a player had won 100 sweepstakes entries initially, those entries may be reduced by 10% every week they go unassigned. Expiration can also linked to desire, if a user participate in a desired activity the expiration period can be extended and/or in one embodiment be eliminated. One skilled should appreciate that use policies and enhancements can be modified to incent a player to take a specific action.

In another embodiment, actions taken by the player are required to trigger enhancements of the sweepstakes entries or features of the sweepstakes system. As an example, a lottery would require the purchase of a specific ticket in order to extend the expiration dates of all his/her sweepstakes entries. Similarly, a casino would require a player to spend a minimum amount of money on the gaming floor before allowing the player to retain unassigned sweepstakes entries. As another example, multiplication of a player's sweepstakes entries would only occur after the player has visited a gaming establishment and validated their ticket.

Sweepstakes Entries Repository

In one embodiment, a sweepstakes entries repository is implemented to allow players to store entries and be provided certain features related to that repository. Rather than having to allocate the sweepstakes entries immediately, the player is allowed to accumulate the entries and allocate them at a time of his or her choosing. In this sense, the sweepstakes entries become a currency that can be accumulated, traded, assigned or sold. The repository could include features such as providing balance statements, loans of entries, exchange of entries (e.g. 1 Porche drawing entry for 100 Hyundai drawing entries), conversion of entries to another currency (selling), etc. The repository could be provided as a free service or could be paid for through maintenance or transaction fees (entries or other currency).

In another embodiment, the repository would allow the player to exchange other currencies for sweepstakes entries. Almost all casinos and lotteries have player clubs where players can accumulate points based on their activity such as spend at the casino or a lottery retailer. In this embodiment, the player can exchange player club points for sweepstakes entries. It should be apparent to one skilled in the art that the alternate currency could include a variety of currencies or items of value, including, but not limited to: cash, player club points, free slot play, coupons, other loyalty club points, etc.

The repository could also facilitate the trading of entries among participants. Sweepstakes entries may have restrictions or improved features that would make them of varying value (real or perceived) to different individuals. At that point, a sweepstakes entries trading facility can benefit individuals by allowing them to exchange entries with other individuals to maximize the value of the entries.

In another embodiment, the user could convert sweepstakes awards into additional sweepstakes entries by requesting the repository to convert the award into a pre-determined equivalent value of sweepstakes entries.

In one example, a sweepstakes entry trading system is provided. The system accepts bids and offers of sweepstakes for exchange. Offers can be presented on a first come basis but can also include auction style bidding with the entries going to a highest bidder. The trading system matches bids and offers, generally facilitating trading between users. In some embodiments, an associated "fee" can be required to participate in the exchange. In one example, a reduction of retained entries may accompany participation in an entry trading system. In another example, participation in the trading system can required specific activity on the part of the user.

Required activities can be designated by a gambling establishment operator, a gaming operator, a sweepstakes provider, or other management entity. The activities themselves can come in many forms. In particular, a sweepstakes provider can require that only users who have performed an action are able to trade sweepstakes entries into a sweepstakes game. The action may be associated with gambling activity. In one example, a player can be required to have entered at least one $20 ticket code in a bonus play system. Additionally, the required activity can be directed into any game, or even other desired activity. For example, an operator may wish to encourage visits to an affiliated location, and only users who made a purchase at the designated affiliate are permitted to trade entries. In another example, a casino operator can require a minimal play level in order for trading to be permitted. According to some alternatives, a casino operator can specify any of a game, an amount wagered, a time of play, a location of play and/or any combination thereof.

Figure 6:
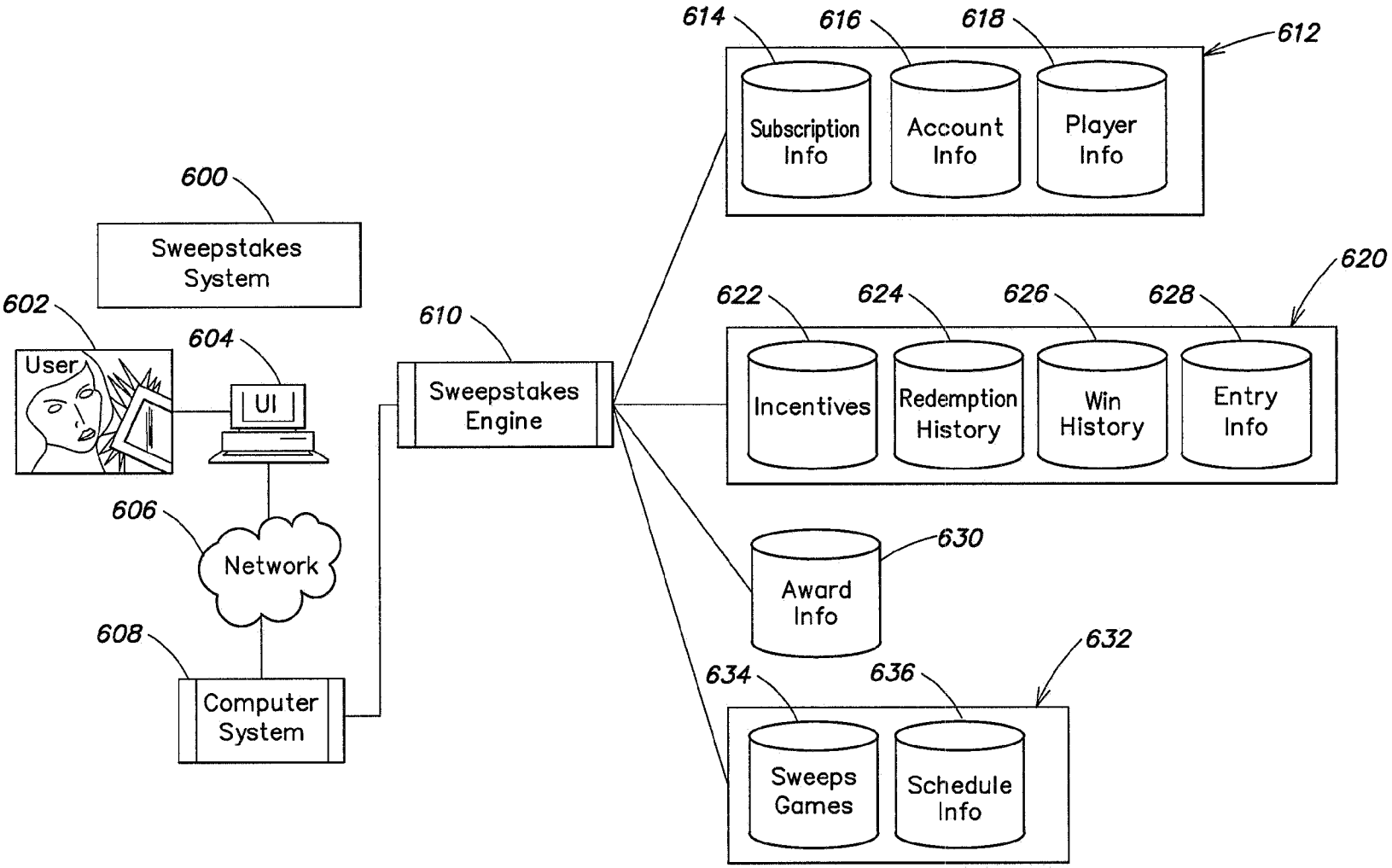
FIG. 6 is a block diagram of an example sweepstakes system, according to aspects of the invention.

FIG. 6 illustrates an example sweepstakes system 600, including a computer system with a sweepstakes engine 610 that is specially configured to provide for at least some of the various functions and operations discussed herein. In particular, the sweepstakes engine 610 is connected to stored information, in this example database storage that includes player information on player info database 618, account information on account information database 616 and any associated subscription information on subscription database 614 provided by database server 612. The sweepstakes engine also has access to and can write information into any of an incentive database 622, redemption history database 624, win history database 626, entry information database 628 provide by database server 620, and further is connected to award information database 630, sweepstakes game information database 634, and scheduling information database 636 on database server 632. One should appreciate the many implementations of a sweepstakes system is possible, and that additional information sources may be employed, additional fewer information storage sources can be implemented. In some alternatives, different database architectures are used. In other alternative different storage systems are used.

User 602 can access computer system 608 through network 606 on the user's host computer 604. Sweepstakes engine 610 runs on computer system 608 to provide user access to management operations associated with sweepstakes entries. In some embodiments, sweepstakes engine 610 causes host computer 604 to render a user interface in a web page accessed user a conventional browser program on host computer 604. The interface can provide access to the function and operations discussed herein. In one example, the sweepstakes engine 610 configured to permit the user to established use policies for warded sweepstakes entries. The use polices can include, for example, options to automatically enter awarded sweepstakes into sweepstakes games with a minimum threshold for odds of winning. Other examples include, the ability to define preferred games to automatically enter, and in yet others define operations to include accumulation of a specific number of entries, and upon achieving that number employing all the entries to participate in a single sweepstakes games.

In some embodiments, sweepstakes engine 610 provides for a sweepstakes entry repository and/or exchange. The sweepstakes repository provides information to the user on all accumulated entries and the details associated with the accumulated entries. For example some sweepstakes entries can be awarded with specific time limit Accumulation of expiring entries can present issues with failing to redeem the awarded entry before expiration. In some settings, use policies can be implemented by the user to insure that expiring entries are redeemed and the user is entered into the sweepstakes by selection a default sweepstakes to enter upon reaching the expiration time. In one alternative, the repository functions can also include an exchange operation. Entries about to expire can be exchanged for entries with more time or even exchange for entries without expiration. In another setting, the sweepstakes engine can be configured to permit use policies to define actions associated with exchanging sweepstake entries. For example, as a block of entries was approaching expiration the use policy could execute an automatic exchange. A user could configure certain limitations, for example, exchange only at 40% or less discount. Users could also configure other limitations on the use policies. The use policy could also be configured to account for various remaining time possibilities 40% discount or less with 12 hours remaining 60% discount or less with 6 hours remaining.

The various use policies can be stored in the databases accessible by the sweepstakes engine 601. Further exchange operations provided by sweepstakes engine 610 could be hosted on system 608 or in one alternative could be provide by other computer systems connected to computer system 608.

Automatically Generated Sweepstakes Pools

Another aspect of the invention is the use of automatically generated and closed sweepstakes pools. In one embodiment, the sweepstakes system automatically creates a new sweepstakes pool in response to certain criteria or actions. These criteria include, but are not limited to: an existing sweepstakes pool being closed, the start of a new time period for the sweepstakes program, a change in the sweepstakes prize, etc. Similarly, the sweepstakes pool may be closed automatically in response to certain criteria. These criteria include, but are not limited to: the maximum number of entries has been received, the end of a time period for the sweepstakes program, a change in the sweepstakes prize, etc. In these examples, the sweepstakes are not necessarily drawn on a specific date, but instead are drawn when the criteria has be met for closing the sweepstakes.

In one embodiment, the sweepstakes operator can establish a set of self-renewing sweepstakes that allow the players to calculate the probability of winning if there are a pre-determined, maximum number of entries for the sweepstakes. These self-renewing sweepstakes are not drawn on a specific date, but instead are drawn when a certain number of total entries are reached. Once the sweepstakes ends, a new sweepstakes begins. In another embodiment, the player may be guaranteed a win if the self-renewing sweepstakes allows the assignment of the total number of sweepstakes entries to that individual. In this case, the element of chance is taken out of the sweepstakes and the player is exchanging sweepstakes entries directly for the sweepstakes prize.

In another embodiment, the sweepstakes system may set up self-renewing sweepstakes that have a fixed chance of winning with some percentage hold. As an example, the sweepstakes system may be set up to award 90 sweepstakes entries, while limiting the number of entries to 100 entries. In this example, the sweepstakes operator has a hold of 10%. A player could then calculate the odds that they would want to enter their entries. If the player submits 10 entries, they have a 1 in 10 chance of winning 90 entries (9:1 odds). A player could accumulate (or lose) sweepstakes entries purely by playing the fixed-odds, self-renewing sweepstakes for more sweepstakes entries.

Concurrently Running Multiple Sweepstakes

A fundamental benefit of the present invention is that the sweepstakes system is able to run multiple sweepstakes concurrently—from a small number of sweepstakes to individual sweepstakes for each single prize available for award. By allowing the sweepstakes entrant to choose from a list of available sweepstakes, the act of allocating entries is handled by the entrant and does not require operator intervention.

By allowing multiple sweepstakes to be run simultaneously, the system then facilitates the separation of prizes to increase player interest and participation. Instead of a single sweepstakes drawing that has multiple prizes, the system accommodates multiple sweepstakes drawings of single (or small groups of) prizes or prize types. This provides more value, real or perceived, to the end user. An example of a typical sweepstakes prize structure is: 1 Grand Prize (e.g. exotic sports car), 10 $2^{nd}$ Place Prizes (e.g. sport utility vehicle), 100 $3^{rd}$ Place Prizes (e.g. Red Sox season tickets), and 500 $4^{th}$ Place Prizes (e.g. flat screen TV). Typically, this would equate to a single sweepstakes drawing where 611 total winners are drawn. With the present invention, this could broken into 4 sweepstakes drawings (1 for each prize type), or 611 sweepstakes drawings (1 for each prize), or any number of sweepstakes drawings between 1 and 611 (depending on the combination of prizes). A sweepstakes entrant can then decide what prize or combination of prizes is most valuable to them, either explicitly or taking into account the odds of winning.

Prizes that are of lesser or niche value that may only be of interest to a portion of the sweepstakes entrants can be accommodated with the present invention. While it would be unlikely for a person to enter a sweepstakes solely to win a T-shirt, it is likely that some portion of the sweepstakes entrants might assign some entries for a drawing to win the T-shirt if they had better than a 20% (as an example) chance of winning Entrants could decide what is more valuable for them: a 20% chance of winning a T-shirt or a 1-in-1,000,000 chance of winning a Porsche Boxster. If the person has enough entries, they might even choose both to possibilities. Similarly, niche prizes that may only appeal to a sub-set of the sweepstakes entrant population can be accommodated with the present invention. While a percentage of the sweepstakes entrants may not be interested in winning a velvet Elvis painting, there are others who would highly value winning such a prize. The present invention allows multiple, individual sweepstakes to be run concurrently or with overlapping eligibility dates, thus allowing multiple, individually-valued prizes to be awarded.

Additional Benefits to the Sweepstakes Operator

The sweepstakes operator also receives significant value from a user-controlled sweepstakes entries system. The amount of entries assigned to a certain sweepstakes drawing and associate prize is a de facto valuation of that prize by the sweepstakes entrant population. While the sweepstakes operator has a perception of prize value to the sweepstakes entrants, the assignment of sweepstakes entries by the entrant population is a true indicator of prize value. The valuation of the prize would be a function of, among other factors: the number of entries assigned, the duration of sweepstakes availability, the total number of entries, and outstanding unassigned entries. The sweepstakes operator could then improve the efficacy and profitability of the sweepstakes system by using the prize valuation to optimize the prizes offered using factors and metrics such as prize cost per sweepstakes entry.

In another embodiment of the present invention, information about the sweepstakes entrant or population of entrants can be determined based on their allocation of sweepstakes entries. Some examples of the information that can be determined are: risk/reward tolerance, brand affinities, personal affinities, prize valuations, etc. This information can be used to tailor sweepstakes programs in general or to individual users. The information can also be used in building a profile of the individual user that can then be used to more effectively market to that individual's affinities. Moreover certain actions performed by an individual user can have greater effect on a player's profile. In one example, a decision by a player to exchange a certain number of entries into one sweepstakes with a specific prize for a reduced number of sweepstakes entries into another sweepstakes with another stated prize can be weighted more heavily in a player behavior analysis model. Holding other factors constant, not only can the sweepstakes operator infer that the prize of the second sweepstakes is more valuable than the sweepstakes award of the first, but a player profile can include a player preference for awards the same as or similar to the prize of the second sweepstakes. In another example, the player profile can be used to predict player behavior when presented with various types of to sweepstakes each with its own prize.

Figure 2:
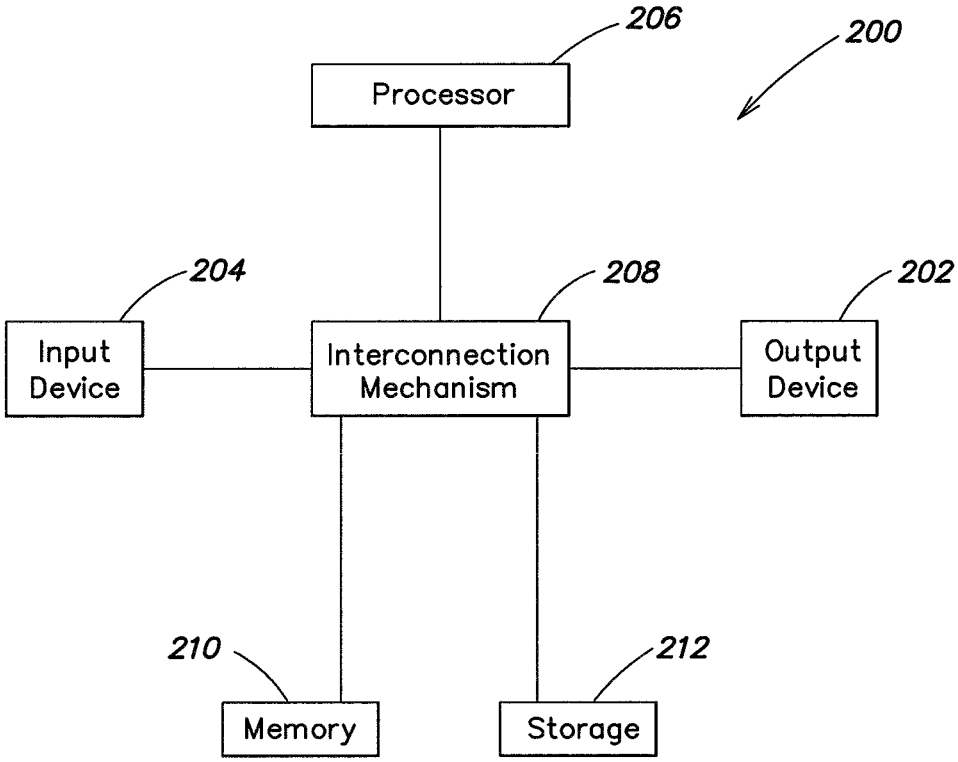
FIG. 2 is a block diagram of an example system for conducting sweepstakes, according to aspects of the invention.
Figure 3:
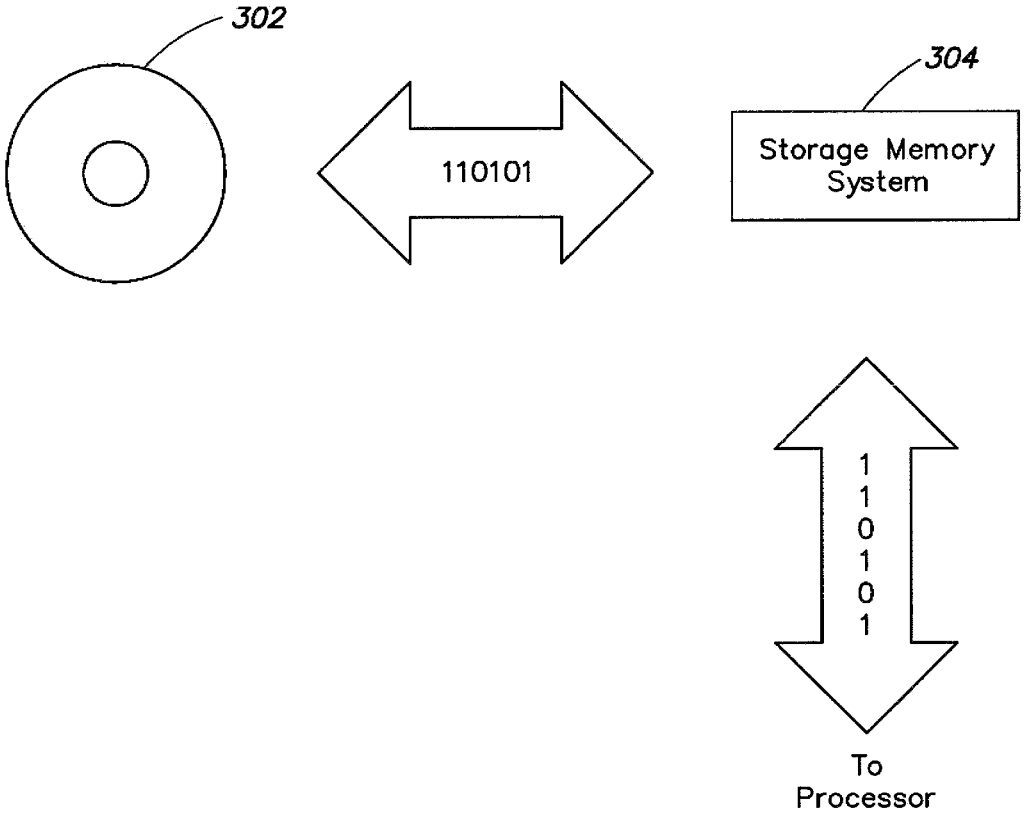
FIG. 3 is a block diagram of an example system for conducting sweepstakes, according to aspects of the invention.

FIG. 1 shows an embodiment of an example interface according to various aspects of the invention. FIGS. 2 and 3 illustrate various elements of a general purpose computer system that is configured to be a specialized computer system that can perform various aspects of the present invention. The specialized computer system is programmed to perform functions and operations discussed herein, such functions include providing an entry into a sweepstakes game to a player, associating the entry into the sweepstakes game with a unique identifier, providing a plurality of sweepstakes games through for example a graphical user interface, providing a graphical user interface that permits access to awarded entries, a graphical user interface that permits awarding of sweepstakes entries, other functions include for example permitting the player to assign sweepstakes entries to at least one sweepstakes game, and permitting the player to accumulate entries. Other operations performed by such specially configured systems include communication over communication networks (e.g. the Internet and other electronic communication networks). The functions and operations discussed herein may be distributed across multiple systems.

Figure 5:
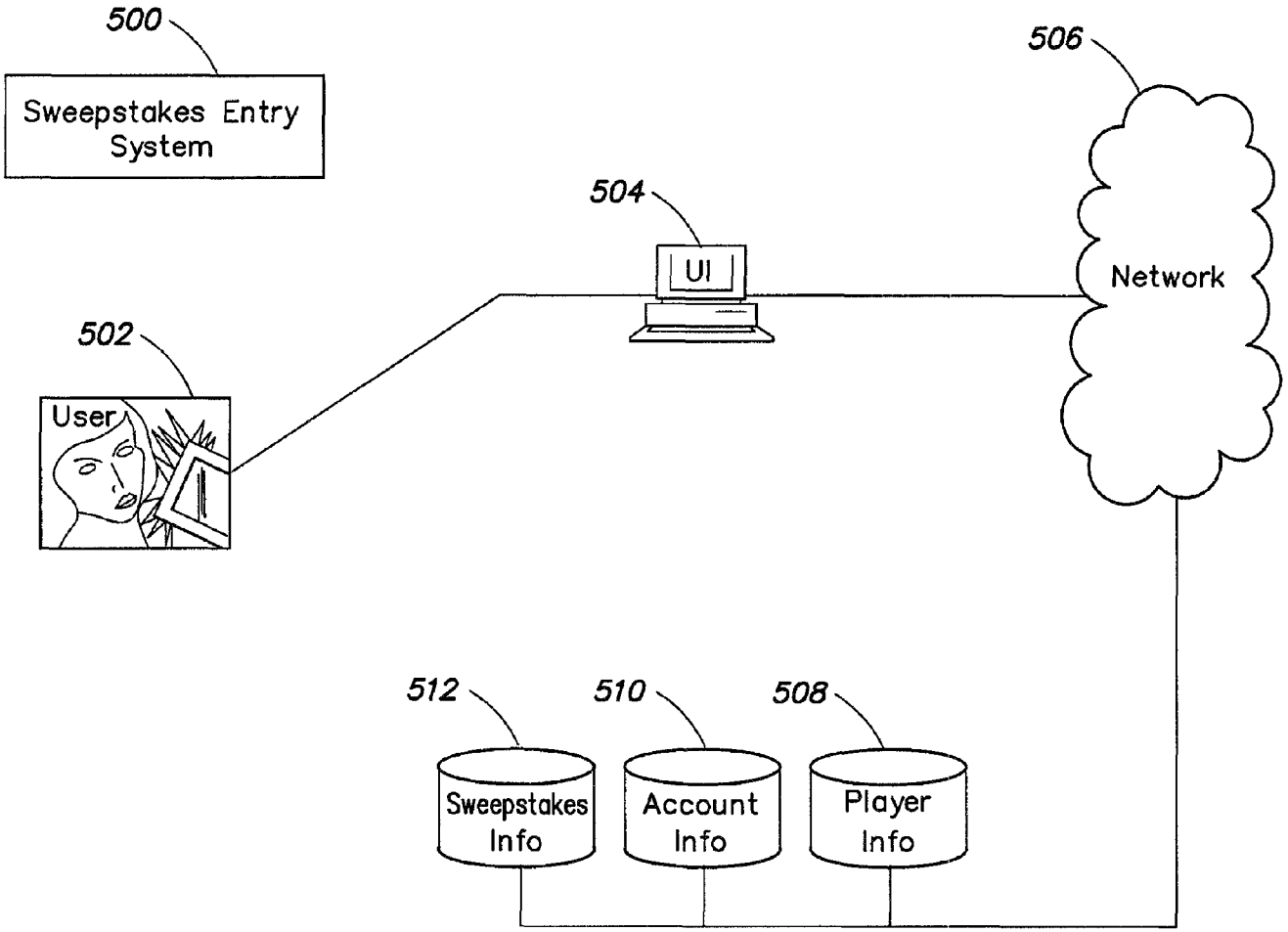
FIG. 5 is a block diagram of an example sweepstakes entry system, according to aspects of the invention.

FIG. 5 illustrates an example of a sweepstakes entry system 500, through which a user 502 accesses sweepstakes information by accessing a graphical user interface displayed on a host computer 504 to access an online source of sweepstakes information. In one embodiment, the sweepstakes entry system provides for the user to accumulate sweepstakes entries, trade sweepstake entries, and further provides for a user to allocate entries into displayed sweepstakes games. The host computer 504 can access player information stored on an online server in a database. The host computer 504 accesses the server over a communication network and the server accesses account information stored in an account information database 510 to, for example, authenticate the player. The server can retrieve additional information on the player and any stored preferences from a player information database 508. Any player preferences can be used to filter sweepstakes information retrieved from a sweepstakes information database 512 and presented to the player in the user interface on their host computer 504. Databases 508-512 are illustrated as separate databases, however, one should appreciate that different database architectures are contemplated and further different computer storage mechanisms can be employed.

Figure 7:
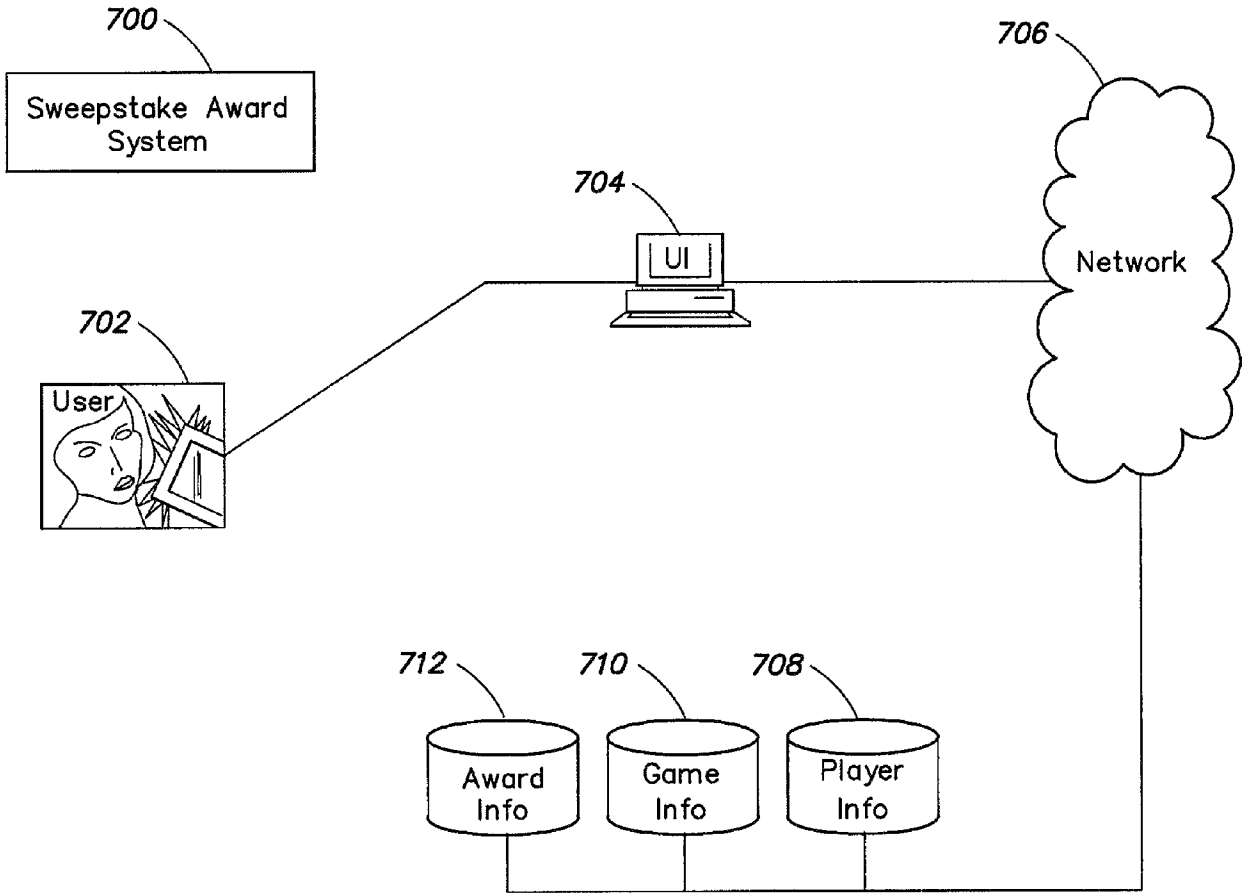
FIG. 7 is a block diagram of an example sweepstakes award system, according to aspects of the invention.

FIG. 7 illustrates an example embodiment of a sweepstake award system. Typically, a user 702 is provided access to the sweepstakes award system through a computer user interface displayed on host computer 704. Host computer 704 can be connected to a sweepstake award system 700 through network 706, for example the Internet. A user may play a game and in response be awarded sweepstakes entries. In some embodiments, the sweepstakes award system 700 may include a game play system (not shown) and in some embodiments the sweepstakes award system can be operatively connected to a game play system. The sweepstakes awards system can be operatively connected to a separate sweepstakes entry system configured to retain information on awarded entries. The award and entry systems can be one system and in some embodiments can be separate systems that communicate. Sweepstakes award system 700 can be configured to provide sweepstakes entries as awards for user game play activity, related user activity, among other options. Sweepstake award system 700 can retain information on award requirements in database 712 and available games in game info database 710. Sweepstakes award system 700 can be configured to build information on players and store that information in a player info database 708. The player information database 708 can be queried to determined eligibility for a user to receive an award. In some embodiments, player info database 708 includes authentication information for authenticating a user accessing sweepstakes award system 700. In some settings, game operators can access a sweepstakes award system 700 to establish awards, available games, game requirements, and player requirements stored in databases 708-712. Multiple sweepstakes operators can each provide a plurality of sweepstakes opportunities and/or games played to earn awards. Sweepstakes operators can access sweepstakes award system 700 to configure the awards provided to users. In some embodiments, sweepstakes and/or game operators can access sweepstakes award system 700 to reconfigured existing games and/or awards. Game operators can revise and/or create new criteria associated with existing sweepstakes, and further can revise any criteria for games or awards.

Figure 8:
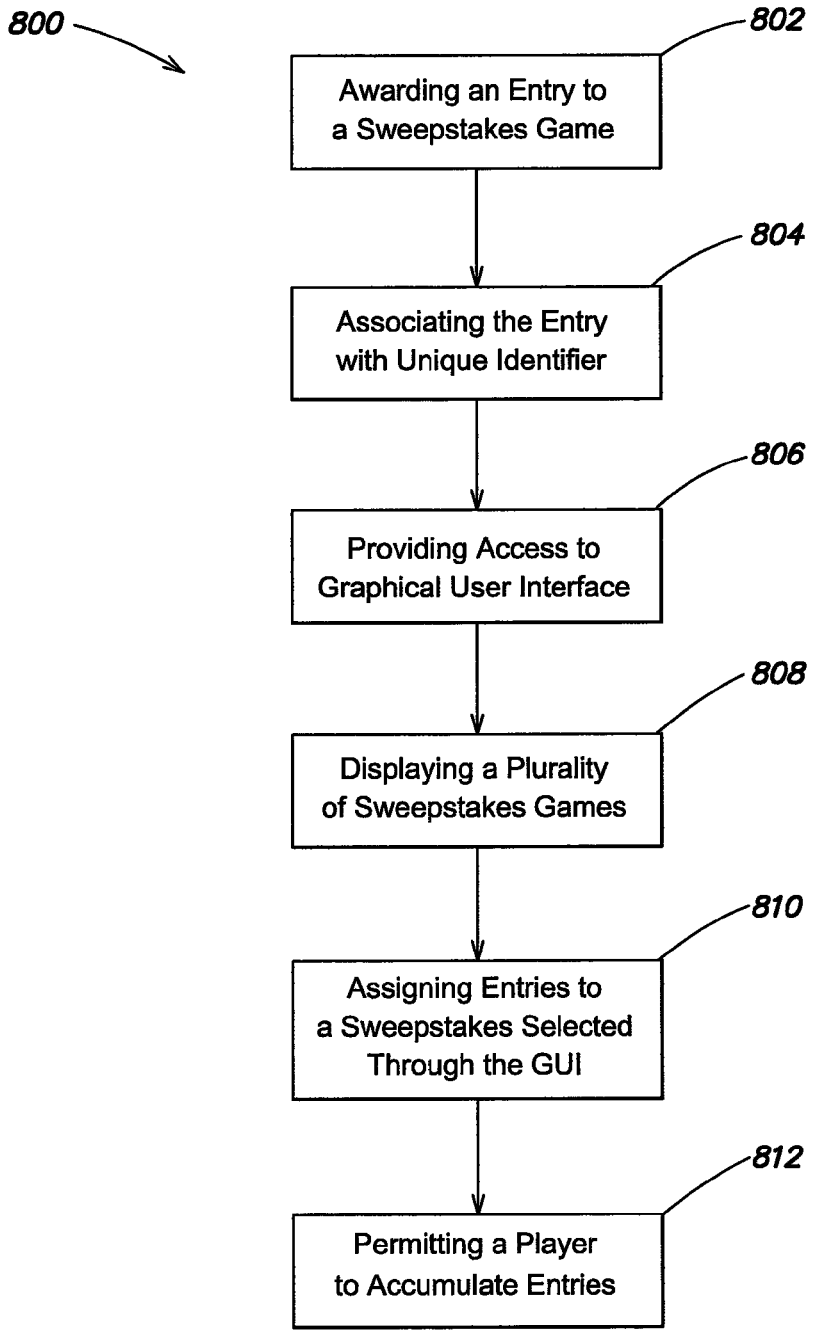
FIG. 8 is an example process for providing a user controlled gaming award, according to aspects of the invention.

FIG. 8 illustrates an example process 800 for providing a user controlled gaming award. Process 800 begins by awarding an entry to a sweepstakes game. In some examples, initial awards can be provided to a user as part of a promotion. In other examples, a user accesses an online game system, and in response to game play the user is awarded sweepstakes entries. The awarded entries can be associated with a unique identifier at 804 permitting each entry and/or groups of entries to be provide with specific criteria. For example, each entry can be associated with a specific sweepstakes game. In some example, entries can be awarded that provide access to multiple sweepstakes games. In one embodiment, entries are awarded, and each entry is associated with a sweepstakes game level. The entry is configured to provide to access to a sweepstakes game with a matching level. In some settings, levels can be determined based on the value of any prize associated with the sweepstakes.

Once a user/player has been awarded sweepstakes entries, the player can access a system online to use the entries. In one example, the user/player accesses a graphical user interface displayed on a browser program executing on their host computer. In one embodiment, the user accesses a user interface for a sweepstakes system. At 808, the sweepstakes system displays a plurality of sweepstake games that the user/player can enter. In some embodiments, the sweepstake games displayed can be based on the games the player is qualified to view and/or enter. In other embodiments, the player can configured his/her account to display only games that meet the player's criteria. In some settings, the sweepstake games for which the user has entries will be displayed. In one example, sweepstake games for which the user has entries will display even if user settings would filter those games.

At 810, the user can assign entries to a sweepstakes game selected through a graphical user interface. In one embodiment, entries must be assigned by the user to participate in the sweepstakes. In other embodiments, the user can define use policies that cause entries for specific sweepstakes games to be assigned automatically. Further the user can define policies that assign entries based on specified preference. For example, entries can automatically be assigned if an odds of winning threshold is satisfied. In addition to assigning entries at 810, a user/player can be permitted to accumulate entries for use at a later time. At 812 a user/player is permitted to accumulate entries for later user. For example, the user can indicate in the user interface that certain entries should not be used and instead should be stored for later use. In some settings step 812 can occur instead of 810. And in other settings, step 812 can occur prior to 810.

Stored entries that have not been assigned, can be accumulated and used to permit a user to enter into a single sweepstakes multiple times, permit better odds of winning a given sweepstakes, and even in some examples to capture all the entries for a given sweepstakes.

Various embodiments according to the present invention may be implemented on one or more computer systems. These computer systems may be, for example, general-purpose computers such as those based on Intel Atom, Core, or PENTIUM-type processor, IBM PowerPC, AMD Athlon or Opteron, Sun UltraSPARC, or any other type of processor. It should be appreciated that one or more of any type computer system can be used to provide access to sweepstake registration systems, sweepstake award systems, sweepstake entry to systems, award games, sweepstakes games, graphical user interfaces, to award sweepstakes entries, permit a player to assign sweepstakes entries, manage sweepstakes entries of varying value, permit use policies and automatic entry based on user and/or operator defined settings, permit banking of awarded entries, permitting exchange of awarded entries, manage automatically generated sweepstakes pools, manage multiple concurrently running sweepstakes, including a plurality of sweepstakes operators. Further, the system may be located on a single computer or may be distributed among a plurality of computers attached by a communications network.

A general-purpose computer system according to one embodiment of the invention is configured to perform any of the described operations and/or algorithms, including but not limited to providing for management of sweepstakes games, award games, rendering of graphical user interfaces to permit user defined use policies, sweepstakes filters, accumulation of awarded entries, exchange of awarded entries, management of sweepstakes games, reconfiguring sweepstakes games and/or awards, among other options. It should be appreciated, however, that the system may perform other operations and/or algorithms, including operations for registering players, providing access to award games, awarding entries outside of gaming activity, rendering an entry assignment interface, rendering an exchange interface, providing customized entries, providing entries associated with time limitations and/or other limitations, establishing levels associated with entries, managing the entries including any limitations and/or associated information, etc. The operations and/or algorithms described herein can also be encoded as software executing on hardware that define a processing component, that can further define portions of a specially configured general purpose computer, reside on an individual specially configured general purpose computer, and/or reside on multiple specially configured general purpose computers.

FIG. 2 shows a block diagram of a general-purpose computer system 200 in which various aspects of the present invention can be practiced. For example, various aspects of the invention can be implemented as specialized software executing in one or more computer systems including general-purpose computer systems 904, 906, and 908 communicating over network 902 shown in FIG. 9. Computer system 200 may include a processor 206 connected to one or more memory devices 210, such as a disk drive, memory, or other device for storing data. Memory 210 is typically used for storing programs and data during operation of the computer system 200. Components of computer system 200 can be coupled by an interconnection mechanism 208, which may include one or more busses (e.g., between components that are integrated within a same machine) and/or a network (e.g., between components that reside on separate discrete machines). The interconnection mechanism enables communications (e.g., data, instructions) to be exchanged between system components of system 200.

Computer system 200 may also include one or more input/output (I/O) devices 202-204, for example, a keyboard, mouse, trackball, microphone, touch screen, a printing device, display screen, speaker, etc. Storage 212, typically includes a computer readable and writeable nonvolatile recording medium in which instructions are stored that define a program to be executed by the processor or information stored on or in the medium to be processed by the program.

The medium may, for example, be a disk 302 or flash memory as shown in FIG. 3. Typically, in operation, the processor causes data to be read from the nonvolatile recording medium into another memory 304 that allows for faster access to the information by the processor than does the medium. This memory is typically a volatile, random access memory such as a dynamic random access memory (DRAM) or static memory (SRAM). In one example, the computer-readable medium is a non-transient storage medium.

Referring again to FIG. 2, the memory can be located in storage 212 as shown, or in memory system 210. The processor 206 generally manipulates the data within the memory 210, and then copies the data to the medium associated with storage 212 after processing is completed. A variety of mechanisms are known for managing data movement between the medium and integrated circuit memory element and the invention is not limited thereto. The invention is not limited to a particular memory system or storage system.

The computer system may include specially-programmed, special-purpose hardware, for example, an application-specific integrated circuit (ASIC). Aspects of the invention can be implemented in software, hardware or firmware, or any combination thereof. Although computer system 200 is shown by way of example as one type of computer system upon which various aspects of the invention can be practiced, it should be appreciated that aspects of the invention are not limited to being implemented on the computer system as shown in FIG. 2. Various aspects of the invention can be practiced on one or more computers having a different architectures or components than that shown in FIG. 2.

It should also be appreciated that the invention is not limited to executing on any particular system or group of systems. Also, it should be appreciated that the invention is not limited to any particular distributed architecture, network, or communication protocol.

Various embodiments of the invention can be programmed using an object-oriented programming language, such as Java, C++, Ada, or C# (C-Sharp). Other object-oriented programming languages may also be used. Alternatively, functional, scripting, and/or logical programming languages can be used. Various aspects of the invention can be implemented in a non-programmed environment (e.g., documents created in HTML, XML or other format that, when viewed in a window of a browser program, render aspects of a graphical-user interface (GUI) or perform other functions). The system libraries of the programming languages are incorporated herein by reference. Various aspects of the invention can be implemented as programmed or non-programmed elements, or any combination thereof.

Various aspects of this invention can be implemented by one or more systems similar to system 200. For instance, the system can be a distributed system (e.g., client server, multi-tier system) comprising multiple general-purpose computer systems. In one example, the system includes software processes executing on a system associated with conducting sweepstakes, which can include operations such as awarding sweepstakes entries, permitting redemption of awarded entries, player registration, providing a web based interface to accept registration information, providing a web based interface to permit a player to assign awarded entries, accumulating awarded entries, exchange awarded entries, define use policies for performing actions with entries based on user defined criteria, as examples. The systems may permit the end users to access and manage their awarded entries, registration information, available award games, available sweepstakes games, filter displayed sweepstakes games based on user preference and/or qualification, further the system can permit sweepstakes operators to access existing games to configured qualification, established sweepstakes prizes, entries awarded based on activity, for example.

There can be other computer systems that perform functions such as receiving and associating sweepstakes entry information with a unique identifier, permitting individualized entry awards on an individual player basis, as well as on an individual entry award basis, the systems can also manage any limitation on the entries, including for example an expiration time, a sweepstakes level, and other associated criteria. These systems can also be configured to operate an exchange between users for swapping entries. These systems can be distributed among a communication system such as the Internet. One such distributed network, as discussed below with respect to FIG. 9, can be used to implement various aspects of the invention.

Figure 9:
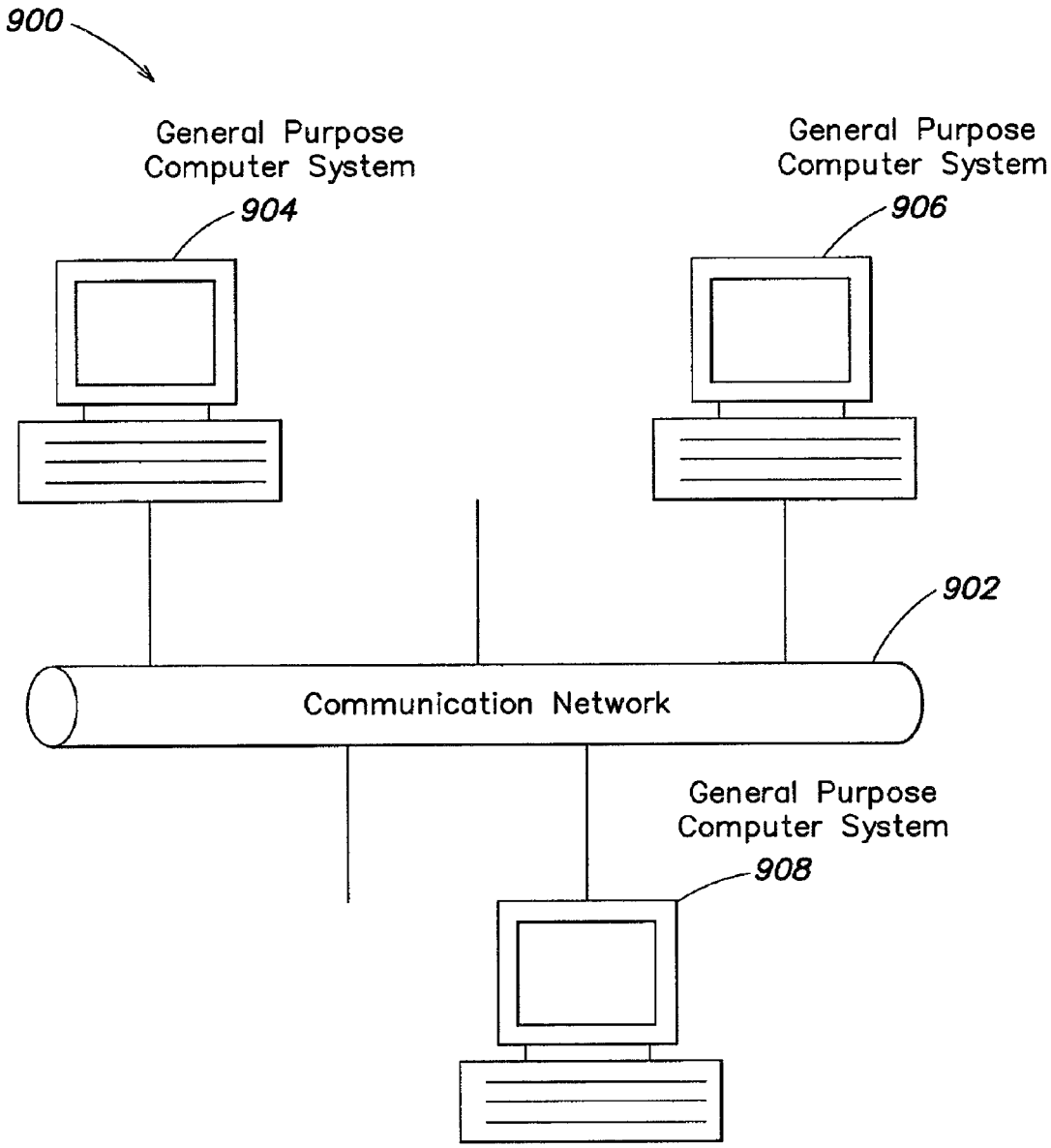
FIG. 9 is a block diagram of an example system for conducting sweepstakes, according to aspects of the invention.

FIG. 9 shows an architecture diagram of an example distributed system 900 suitable for implementing various aspects of the invention. It should be appreciated that FIG. 9 is used for illustration purposes only, and that other architectures can be used to facilitate one or more aspects of the invention. System 900 may include one or more general-purpose computer systems distributed among a network 902 such as, for example, the Internet. Such systems may cooperate to perform functions related to conducting sweepstakes and/or managing a plurality of sweepstakes offered by a plurality of operators. In an example of one such system, one or more users operate one or more client computer systems 904, 906, and 908 through which the user/player can access a sweepstakes entry system, access a sweepstakes award system, access awarded entries, assign awarded entries, accumulate entries and potentially exchange awarded entries. It should be understood that the one or more client computer systems 904, 906, and 908 may also be used to access, for example, registration systems, award systems, entry systems, sweepstakes operator management systems, etc. In one example, users interface with the system via an Internet-based interface.

In another example, a system 904 includes a browser program such as the Microsoft Internet Explorer application program, Mozilla's FireFox, or Google's Chrome browser through which one or more websites can be accessed. Further, there can be one or more application programs that are executed on system 904 that perform functions associated with conducting sweepstakes. For example, system 904 may include one or more local databases for storing, caching and/or retrieving registration information, awarded entries, limitations and/or values associated with the awarded entries, etc.

Network 902 may also include, as part of the system for conducting sweepstakes, one or more server systems, which can be implemented on general-purpose computers that cooperate to perform various functions including accessing an entry assignment interface, entering registration information, executing award games, selecting sweepstakes games, accumulating entries in a repository among other functions. System 900 may execute any number of software programs or processes and the invention is not limited to any particular type or number of processes. Such processes can perform the various workflows associated with a system for conducting sweepstakes and any associated methods.

Having now described some illustrative embodiments of the invention, it should be apparent to those skilled in the art that the foregoing is merely illustrative and not limiting, having been presented by way of example only. Numerous modifications and other illustrative embodiments are within the scope of one of ordinary skill in the art and are contemplated as falling within the scope of the invention. In particular, although many of the examples to presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments. Further, for the one or more means-plus-function limitations recited in the following claims, the means are not intended to be limited to the means disclosed herein for performing the recited function, but are intended to cover in scope any means, known now or later developed, for performing the recited function.

As used herein, whether in the written description or the claims, the terms "comprising", "including", "containing", "characterized by" and the like are to be understood to be open-ended, i.e., to mean including but not limited to. Only the transitional phrases "consisting of" and "consisting essentially of" respectively, shall be closed or semi-closed transitional phrases, as set forth, with respect to claims, in the United States Patent Office Manual of Patent Examining Procedures (Eighth Edition 2nd Revision, May 2004), Section 2111.03.

Use of ordinal terms such as "first", "second", "third", "a", "b" "c" etc., in the claims to modify or otherwise identify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

What is claimed is:

1. A method for providing a user controlled gaming award, wherein the user controlled gaming award includes entries in another game, the method comprising the acts of:

providing, by a computer system, an entry into a sweepstakes game to a player based on a game play;

associating, by the computer system, the entry into the sweepstakes game with a unique identifier;

providing a plurality of sweepstakes games;

providing a graphical user interface displayed in a host computer configured to permit to the player to assign sweepstakes entries to at least one sweepstakes game; and permitting, by the computer system, the player to accumulate entries; and further comprising an act of, via the computer system, permitting the player to establish a sweepstakes entry rule that automatically enters the player into at least one sweepstakes game based upon player specified criteria.

2. The method according to claim 1, wherein the act of providing an entry into a sweepstakes game to the player includes an act of providing a custom currency redeemable for entry into at least one sweepstakes game.

3. The method according to claim 1, further comprising an act of permitting the player to exchange the entry into the sweepstakes game.

4. The method according to claim 1, further comprising an act of permitting the player to exchange the custom currency.

5. The method according to claim 3, further comprising an act of providing an exchange interface for trading of the custom currency.

6. The method according to claim 5, wherein the exchange interface is configured to display information associated with the sweepstakes entry.

7. The method according to claim 6, wherein the information associated with the sweepstakes entry includes at least one of an expiration for the sweepstakes entry, a value of any outcome of a sweepstakes game associated with the entry, a sweepstake game level associated with the entry, a total number of sweepstakes entries submitted for the sweepstakes game associated with the sweepstakes entry, an outcome of the sweepstakes game associated with the sweepstakes entry, a time for redemption of the sweepstakes entry, a cash value of a prize associated with the entry, and a cash equivalent value of a prize associated with the entry.

8. The method according to claim 1, further comprising the acts of:

associating an account with the player; and permitting the player to bank any sweepstakes entry in the account.

9. The method according to claim 8, further comprising an act of reducing any sweepstakes entry balance on a predetermined interval.

10. The method according to claim 1, wherein the act of providing an entry into a sweepstakes game occurs in response to an act of permitting the player to play a game.

11. The method according to claim 1, wherein the act of providing an entry into a sweepstakes game occurs in response to an act of requiring the player to perform an action, play a game.

12. The method according to claim 1, wherein the game includes at least one of a reveal based game, a second chance game, an online game, an offline game, and a game comprising an online and offline portion.

13. The method according to claim 2, wherein the act of providing a custom currency redeemable for entry into at least one sweepstakes game, includes an act of permitting the player to purchase entries into the sweepstakes game using the custom currency.

14. The method according to claim 1, including an act of displaying game related information for at least one of the plurality of sweepstakes games.

15. The method according to claim 14, wherein the game related information includes at least one of a start time, an end time, an enrolment time, a closing time, a minimum number of entries, a maximum number of entry, a sweepstake game status, a current number of entries, a remaining number of entries, a tiering level for the sweepstakes game.

16. The method according to claim 1, wherein the act of providing a plurality of sweepstakes games includes an act of varying a value of outcome of the plurality of sweepstakes game.

17. The method according to claim 1, wherein the act of providing an entry into a sweepstakes game to a player includes an act of assigning a value to the sweepstakes entry.

18. The method according to claim 1, wherein the act of providing an entry into the sweepstakes game to a player includes an act of establishing any restrictions on redemption of the entry.

19. The method according to claim 18, wherein any restrictions on redemption of the entry includes at least one of an expiration for the sweepstakes entry, a value of any outcome of a sweepstakes game associated with the entry, a sweepstake game tier associated with the entry, a total number of sweepstakes entries permitted for the sweepstakes game associated with the sweepstakes entry, an outcome of the sweepstakes game associated with the sweepstakes entry, a time for redemption of the sweepstakes entry, a cash value of a prize associated with the entry, a cash equivalent value of a prize associated with the entry, a maximum cash value of a prize associated with the entry, a minimum cash value of a prize associated with the entry, a maximum cash-equivalent value of a prize associated with the entry, a minimum cash-equivalent value of a prize associated with the entry, any restriction on exchanging the entry.

20. The method according to claim 1, further comprising an act of displaying a leader board in a graphical user interface.

21. The method according to claim 1, wherein the plurality of sweepstakes games includes at least one automatically generated sweepstakes game.

22. The method according to claim 21, further comprising an act of displaying criteria for the at least one automatically generated sweepstakes game, wherein the criteria includes at least one of start time for accepting entries into the at least one automatically generated sweepstakes game, sweepstakes game prize, maximum number of entries, minimum number of entries, and required entry tier.

23. The method according to claim 21, further comprising an act of opening an entry period into a sweepstakes game in response to meeting predefined criteria.

24. The method according to claim 23, wherein the predefined criteria includes at least one of a conclusion of an entry period for another sweepstakes game and a maximum number of entries accepted into a sweepstakes game.

25. The method according to claim 1, further comprising an act of adjusting a number of redeemed sweepstakes entries based on a selected sweepstakes game being entered.

26. The method according to claim 25, wherein the act of adjusting the number of redeemed sweepstakes entries based on the selected sweepstakes game being entered includes an act of reducing the number of redeemed entries by a valuation factor, wherein the provided entry is associated with an outcome of a particular value, and the entered sweepstakes includes an outcome of greater value.

27. The method according to claim 1, further comprising acts of:

determining a valuation factor based at least in part on a relative value of an outcome of the provided entry into the sweepstakes game and a value of an outcome of an entered sweepstakes game; adjusting a number of entered sweepstakes based at least in part on the valuation factor.

28. The method according to claim 27, wherein the act of determining the valuation factor includes an act of adjusting the valuation factor based on player status.

29. A non-transient computer readable medium including instructions for performing a method of providing a user controlled gaming award, the method comprising the acts of:

providing an entry into a sweepstakes game to a player based on a game play;

associating the entry into the sweepstakes game with a unique identifier;

providing a plurality of sweepstakes games;

providing a graphical user interface configured to permit the player to assign sweepstakes entries to at least one sweepstakes game;

permitting the player to accumulate entries; and further comprising an act of, via the computer system, permitting the player to establish a sweepstakes entry rule that automatically enters the player into at least one sweepstakes game based upon player specified criteria.

30. A system for providing a user controlled gaming award, the system comprising:

an awarding component configured to provide an entry into a sweepstakes game to a player based on a game play;

an associated component configured to associate the entry into the sweepstakes game with a unique identifier;

a sweepstakes interface configured to display a plurality of sweepstakes games, and further configured to permit the player to assign sweepstakes entries to at least one sweepstakes game;

a management component configured to permit the player to accumulate sweepstakes entries; and further comprising an act of, via the computer system, permitting the player to establish a sweepstakes entry rule that automatically enters the player into at least one sweepstakes game based upon player specified criteria.

* * * * *